US005318049A

United States Patent [19]

Henderson et al.

[11] Patent Number: 5,318,049

[45] Date of Patent: Jun. 7, 1994

[54] METHOD OF AND APPARATUS FOR DRYING A TOBACCO SAMPLE AND DETERMINING THE MOISTURE CONTENT THEREOF

[75] Inventors: Richard M. Henderson; Roger A. Foote, both of Winston-Salem, N.C.; Aubrey L. Swofford, Greenwood, S.C.; Henry H. Warren, Jr,, Clemmons; D. Randall McHone, Winston-Salem, both of N.C.

[73] Assignee: R. J. Reynolds Tobacco Company, Winston-Salem, N.C.

[21] Appl. No.: 837,129

[22] Filed: Feb. 19, 1992

Related U.S. Application Data

[62] Division of Ser. No. 324,887, Mar. 17, 1989.

[51] Int. Cl.[5] ..... A24B 3/04

[52] U.S. Cl. ..... 131/290; 131/299; 131/305; 131/909; 34/126; 34/137

[58] Field of Search ..... 131/909, 305, 290, 299; 34/56, 50, 33, 126, 136, 137

[56] References Cited

U.S. PATENT DOCUMENTS

| | | | |
|---|---|---|---|
| 2,799,278 | 7/1957 | Bogaty | 131/305 |
| 3,121,621 | 2/1964 | Jackson | 34/126 |
| 3,238,952 | 4/1964 | Ashworth et al. | 131/146 |
| 3,429,317 | 2/1969 | Koch et al. | 131/305 X |
| 4,174,335 | 11/1979 | Avril | 34/137 X |
| 4,414,987 | 11/1983 | Utsch et al. | 131/296 |
| 4,513,759 | 4/1985 | Wochnowski et al. | 131/305 |
| 4,578,878 | 4/1986 | Mizuta et al. | 131/305 X |
| 4,719,928 | 1/1988 | Mitchell, Jr. et al. | 131/312 |
| 4,815,482 | 3/1989 | Clift et al. | 131/300 |

FOREIGN PATENT DOCUMENTS

| | | |
|---|---|---|
| 0132846 | 2/1985 | European Pat. Off. . |
| 1632152 | 1/1971 | Fed. Rep. of Germany . |

OTHER PUBLICATIONS

SWECO Vibro-Energy Separators, 1984 Photographs 1A-1C, 2A-2D of prior art procedure.

*Primary Examiner*—V. Millin
*Assistant Examiner*—J. Doyle
*Attorney, Agent, or Firm*—Grover M. Myers

[57] ABSTRACT

A method of and an appratus for automatically determining the moisture content of a tobacco sample and for then automatically determining the stem content of the tobacco sample are disclosed. The apparatus utilizes a dryer, such as a rotary drum dryer with internal agitating vanes, for applying heat to remove moisture and volatiles from the sample and for reducing the sample to lamina and stem portions. Electronic scales are used to weigh the sample before and after drying to determine and store the "wet" and "dry" weights of the sample. Based on the stored wet and dry weights the moisture content is determined. The stem portions are classified into two categories and weighed to determine the stem content by weight of the sample.

6 Claims, 11 Drawing Sheets

METHOD OF AND APPARATUS FOR DRYING A TOBACCO SAMPLE AND DETERMINING THE MOISTURE CONTENT THEREOF

This ia a divisional of co-pending application Ser. No. 07/324,887 filed on Mar. 17, 1989 still pending.

FIELD OF THE INVENTION

The present invention relates generally to techniques for determining the stem content of tobacco used in the manufacture of smoking articles, such as cigarettes, and more particularly to methods of and apparatus for automatically determining such stem content in a manner which improves the accuracy of the determination and, therefore, the accuracy by which the stemming operation is regulated to produce a more uniform and acceptable tobacco product.

DESCRIPTION OF THE PRIOR ART

In the typical tobacco stemming process, the stem content of a sample of strip tobacco taken from a bale of processed tobacco is first determined. That determined value is then utilized in a feedback-type system to regulate stem content of the strip tobacco undergoing subsequent processing. Reliable control of stem content is essential to assure the quality and uniformity of the final product. Excessive stem content in the tobacco rod of a cigarette, for example, is likely to cause the cigarette to burn unevenly as it is being smoked, and, to a lesser extent, can result in puncturing of the cigarette wrapper during the forming process. Moreover, during the manufacturing process, an excessive stem content can produce irregular draft readings and affect other control parameters which will result in rejection of the product. On the other hand, too little stem content is indicative of uneconomical processing of the original tobacco. In typical present-day equipment, the preselected value for maximum stem content of the tobacco product is maintained by appropriately adjusting the air flow in the pneumatic separator section of the stemming apparatus, to increase or decrease the amount of stem thereby removed from the tobacco being processed, depending respectively on whether the determined value of stem content of the sample is higher or lower than the preselected value.

Previous techniques for ascertaining stem content of tobacco samples have included the use of a manual, discontinuous process which results in an inordinately long interval between the point in time at which the sample is taken and the point at which the stemming operation is adjusted. A core sample is taken from a bale of tobacco strip as the bale is discharged from the stemming operation. The sample is torn apart by hand, and then oven-heated to a predetermined temperature so as to completely dry the sample. After removal from the oven, the dried sample is vibrated and screened to separate the lamina and the stem portion thereof. The lamina and stem are then removed separately and weighed, and the stem content of the sample is determined. Since these steps are carried out manually, a considerable interval may and typically does elapse from the time of removal of the sample to the time the results of the weighings are obtained. In the interim, the strip tobacco is being processed and the stemming operation is being performed in the same manner as had been done for the bale from which the sample was obtained. Therefore, any necessary adjustments to the stemming operation, which are determined from the relative weights of the lamina and stem portions, are delayed. Moreover, manual handling of samples subjects the results to the possibility of human error, which can adversely affect the accuracy of the stem content determination. The prior art also includes an improvement over the manual process, referred to as the ball/sieve method, which provides greater accuracy but without significant reduction in the time required for obtaining the result.

Yet another prior art technique for determining stem content is described in U.S. Pat. No. 3,238,952 to Ashworth et al. According to that disclosure, a sample of strip tobacco is weighed, and then subjected to a short interval grinding operation to thresh the leaf or lamina portion from the stem portion and to reduce the lamina particle size sufficiently to allow it to be conveyed by a controlled flow of air. An air current that enters the grinding chamber from the bottom carries the small particles of leaf and stem through an upper throat section into a separation chamber where the lighter lamina particles exit under the forces exerted by the air stream. The stem particles, which are relatively heavier, are unable to escape and fall back into the separation chamber. The stem particles are then removed and weighed, and are compared with the weight of the original sample to determine the percentage of stem contained in the strip tobacco being processed. Ashworth et al add a constant value as a correction factor to the weight of the recovered stem particles to correlate the results with any standard method, and further take into account the moisture content of the sample.

More recently, apparatus and methods for determining the stem content of tobacco strip samples automatically, without the disadvantages attendant to earlier techniques, have been described in U.S. Pat. No. 4,719,928 to Mitchell, Jr. et al, assigned to the same assignee as the present invention. According to the invention disclosed by Mitchell, Jr. et al, a core sample of strip tobacco is removed from a tobacco bale discharged from the stemming operation, and the sample is introduced into a milling machine where the sample is reduced to small pieces for pneumatic transfer to a drying, cooling and classifying system. In the dryer, the small pieces of the sample are heated until dry (to a specified moisture content, which may be 0% moisture by weight). Then, cooler ambient air is introduced to flow over the sample until its temperature is reduced to a preselected level. This serves to facilitate the classifying process, in which the dried sample is segregated into lamina and stem portions via an automatic screening apparatus. The separate lamina and stem portions are then sequentially discharged for automatic weighing, and signals representative of their respective weights are used to determine stem content.

Although the invention disclosed in the Mitchell, Jr. et al patent represents a distinct improvement of the art prior thereto, it nevertheless suffers, albeit less so than the prior art, from an inability to fully separate and classify the lamina and stem portions of the tobacco sample. It follows that if that portion of the sample considered to consist of stem also contains lamina, and vice versa, then the measurements of the weights (absolute and relative) of the portions deemed to be stem and lamina will be inaccurate, and those inaccuracies will contribute to either excessive or insufficient stem content in the final smoking articles produced from the manufacturing process.

SUMMARY OF THE INVENTION

It is a principal object of the present invention to provide new and improved apparatus and methods for automatically classifying the lamina and stem portions of a cored tobacco sample to more accurately determine the stem content thereof, and thereby to provide greater control of the stem content of smoking articles manufactured from the baled strip tobacco from which or corresponding to the bale from which the tobacco sample was taken.

The present invention provides certain significant improvements in the method and apparatus described in the Mitchell, Jr. et al patent. According to one feature of the invention, the severity of the drying step is significantly increased by employing a dryer which both heats and agitates the tobacco, a technique which the inventors have found to enhance the operation of the automatic apparatus and to improve the accuracy of the results. In the initial process of obtaining the sample, the coring device which is inserted into the bale tends to compress the cored sample into a clump or cake. It is necessary to agitate each sample clump sufficiently to break it up into relatively smaller pieces for purposes of subsequent classification. The prior art techniques have not proved entirely successful to achieve that result. On the other hand, the combination of drying and agitation according to the invention is quite effective to reduce the clumps to more manageable pieces of tobacco at the outset of the classification process and to enhance the subsequent processing of the sample.

To that end, in a first preferred embodiment of the invention a core sample of strip tobacco taken from a tobacco bale is first treated in ball/sieve and pneumatically transported to a fluidized bed dryer which serves to further agitate the tobacco sample while heating it to remove both moisture and volatile organic compounds, such as gums, from the tobacco sample. The fluidized bed dryer is extremely efficient at removal of the moisture and the volatiles.

After the tobacco sample has been thoroughly dried, for example, to a 0% moisture content, it is discharged at the lower end of the dryer into a vibratory separator. The vibratory separator is a conventional apparatus which has been uniquely modified according to a feature of the invention to optimize the separation of the remaining lamina from the stem of the dried sample. The lamina is separated and discarded without weighing and the dried stem is discharged from the vibratory separator to an automatic stem grader.

Another feature of the present invention resides in the automatic grader which operates in a novel manner to segregate and weigh two sizes of the stem portion of the dried sample. In this preferred embodiment, the grader is adapted to receive the stem portion of the dried sample at a screen section which is arranged to retain the stem mixture, but to allow any remaining tobacco fines to fall through and to be discarded. The stem mixture is then conveyed along a grooved section of the grader, as a consequence of automatic vibration of the grader, which causes the stems to undergo alignment in parallel along their long axes as they move under vibration down the grooves. At the discharge end of the grader, the stems encounter a set of parallel, interengaging fingers with spaces therebetween sufficient to allow the smaller stems to pass therethrough to a scale, where they are weighed and then discharged. Thereupon, the fingers are automatically spread to allow passage of the remaining larger stems onto the scale for weighing.

Although techniques have been employed in the prior art to separate the tobacco sample into pieces according to different sizes of stem, they have not accomplished that result with a high degree of efficiency. The importance of classification according to stem size lies in the fact that small stems are acceptable in the final smoking article in larger quantity than stems of a greater size. The grader of the present invention assures that the relative sizes of stem in the tobacco undergoing classification are determined quickly and accurately, and that the permissible content of stem of the different sizes is carefully regulated during the manufacturing process to maintain the quality and uniformity of the smoking article.

The entire sample is weighed prior to drying, so that its moisture content is included in the weight. In a typical sample the exemplary moisture content may be on the order of 13% by weight. After segregation of the lamina and the two sizes of stem portions in the vibratory separator as briefly described above, the lamina is discarded without being weighed. Thereafter, the separate stem fractions are segregated and weighed, and the stem content is determined based upon the relative weights of the entire sample and of the stem portions, with suitable correction factors added to account for the assumed moisture content of the original sample. A figure of 13% is typically used in calculations for dry weight to account for loss of both moisture and volatiles during processing, and is also used to express a relative value for equilibrium moisture/volatiles content of tobacco after storage.

In an alternative second preferred embodiment of the invention, a rotary drum dryer similar to a clothes dryer is employed to agitate and dry the tobacco sample. The heated tobacco continually beats against the internal blades of the rotary drum dryer as the device undergoes rotation. The fluidized bed dryer has the advantage that it may be oriented in such a way that the tobacco pieces fall to the bottom of the device after the heating/agitating step is completed, for convenience of removal and introduction to the next step of the process. In contrast, the rotary dryer is less complex than the fluidized bed dryer, and more adaptable to a change of orientation such that the tobacco sample may be introduced, for example, with the dryer aligned horizontally, and, when the initial threshing has been completed to break up the tobacco clumps, the dryer is readily tilted to a vertical alignment to allow pouring of the dried tobacco pieces from the dryer.

In the alternative preferred embodiment of the invention, the dried tobacco pieces from the rotary drum dryer are poured into a receptacle which is automatically emptied into a two-stage vibratory stem grader similar to the vibratory separator of the first embodiment. In contrast to the first embodiment, the vibratory stem grader of the second embodiment peforms the functions of both the vibratory separator and the automatic stem grader of the first embodiment, namely, separating the lamina from the stems and segregating or grading the stem portion of the tobacco sample into two stem sizes. The two stem fractions from the vibratory stem grader are weighed and discarded in substantially the same manner as in the first preferred embodiment of the invention.

Each of the preferred embodiments of the invention has certain advantages over the other that may determine which of the two embodiments is more suitable for a particular tobacco stemming process. For instance, the first embodiment of the apparatus of the invention occupies less floor space than the second embodiment. On the other hand, the height of the apparatus of the second embodiment is less than the height of the first embodiment. The second embodiment of the invention is somewhat more efficient than the first embodiment because separation of all fractions of the tobacco sample, i.e., the lamina and the two sizes of stem, is carried out in a single separation apparatus rather than in two different apparatuses. Also, the rotary drum dryer of the second embodiment is not as subject to the existence of localized "hot spots" (described below) as the fluidized bed dryer of the first embodiment. Thus, there is less danger of ignition of the tobacco sample in the dryer of the second embodiment.

It will be observed from the foregoing summary that another object of the present invention is to improve the speed and extent of separation of lamina from stem in a tobacco sample to more accurately determine the relative stem content of the sample.

A related object of the invention is to provide methods and apparatus to more accurately determine stem content of a tobacco sample for greater control of the relative stem content in smoking articles produced using the grade of tobacco from which the sample was taken.

It is a further object of the invention to provide improvements in automatic grading and segregating stem by size in cored tobacco samples.

Another object is to provide an improved device for automatically separating lamina from stem of a tobacco sample.

BRIEF DESCRIPTION OF THE DRAWINGS

The above and still further objects, features and attendant advantages of the present invention will become apparent to those skilled in the art from a consideration of the following detailed description of a presently preferred embodiment thereof, taken in conjunction with the accompanying drawings in which.

DETAILED DESCRIPTION OF THE PREFERRED EMBODIMENT

Figure 1:
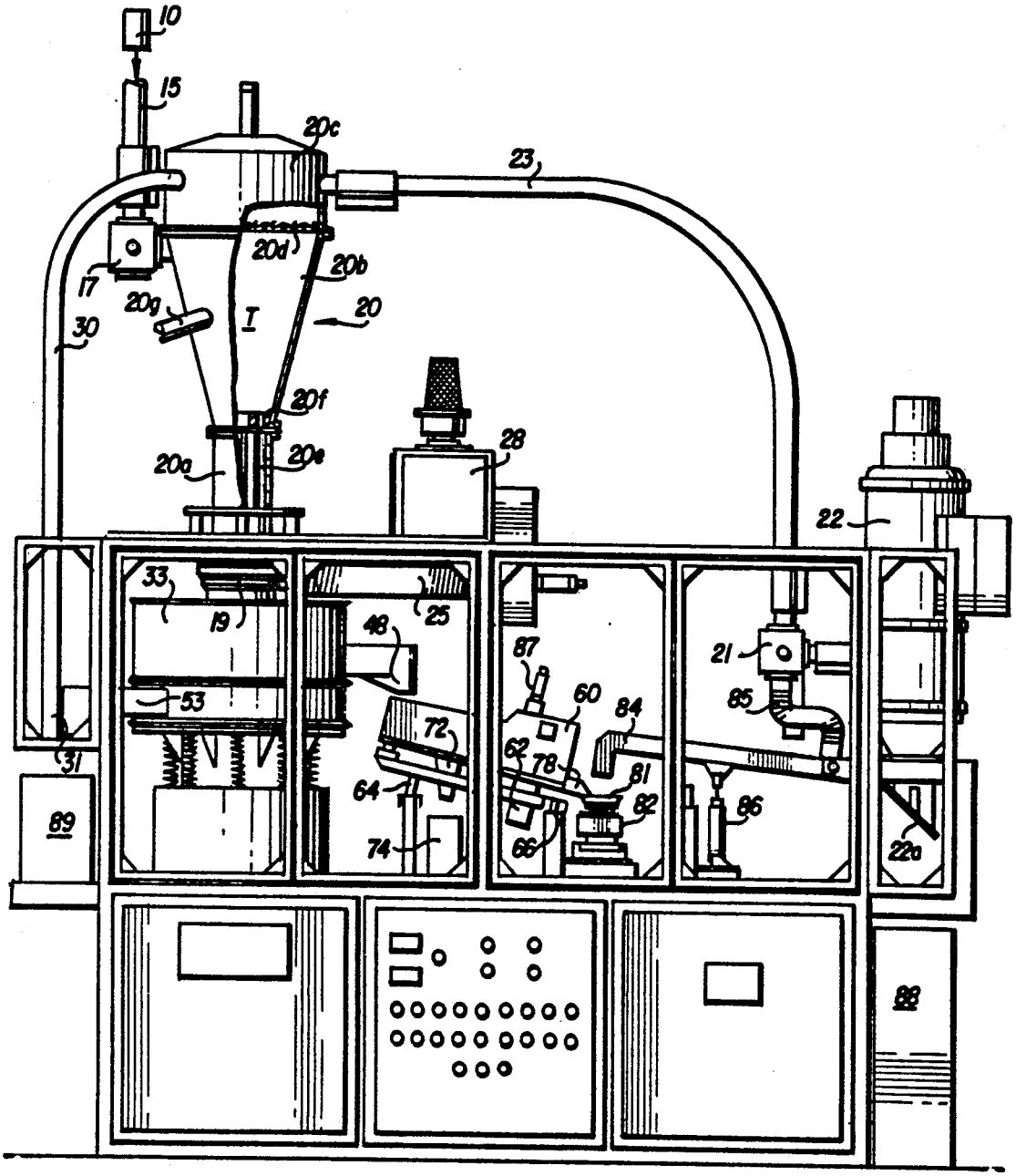
FIG. 1 is a side elevational view, partly in section, of the apparatus according to the first preferred embodiment of the present invention.

Referring now to the drawings, and particularly to FIG. 1, a schematically shown sample 10 of strip tobacco is obtained in any suitable manner, such as via a coring tube, from a bale of compressed strip tobacco (not shown). A suitable sample, for example, may have a weight of approximately 200 grams. After ejection from the coring tube, sample 10 is weighed on a high accuracy electronic scale (not shown), and the digitized signal representative of that weight is stored in a suitable electronic memory. As noted earlier herein, the process by which the sample is removed from the bale, such as by coring, tends to produce further compression of the tobacco in the sample, so that the sample has the appearance and consistency of a large clump or cake of tobacco. For that reason, the sample typically would then be delivered to a conventional device, such as a hammermill, for dividing the sample into smaller pieces. The aforementioned U.S. Pat. No. 4,719,928 to Mitchell, Jr. et al describes one conventional way of obtaining a weighed and separated tobacco core sample taken from a compressed bale or hogshead of tobacco leaf.

According to the present invention, however, considerably better efficiency and results are achieved by subjecting the tobacco sample clump 10 to concurrent heating and agitation, for the initial processing to reduce the sample to a form for determining the stem content thereof. In the first embodiment of the present invention shown in FIG. 1, the tobacco sample 10 is introduced into a fluidized bed dryer 20 through an inlet tube 15 and past open valve 17 by means of a vacuum system which includes a vacuum pump 22, valve 21 and a vacuum line 23. If desired, the sample may be partially separated into pieces before delivery to the dryer by any conventional method. In any event, after the sample is drawn into dryer 20, the vacuum system is deactivated and valve 17 is closed. Any pieces of the sample are prevented from being drawn into the vacuum line 23 by means of screening 20*d* of suitable mesh size extending across the upper cylindrical portion 20*c* of the dryer 20.

The fluidized bed dryer 20 is exemplary of the type of dryer which is not only efficient in removing moisture from the article being dried, but effective to agitate the article at the same time. It is this preprocessing of the tobacco sample by a combination of heating and agitation which produces a more severe drying of the sample and a faster reduction thereof to a mixture of stem portions and lamina portions than is obtained by prior art techniques of tobacco stem content determination. This step of the process is effective not only to remove any volatile organic compounds, such as gums, but also to remove moisture (to 0% by weight, if desired) from the sample.

The fluidized bed of dryer 20 is heated by means of heated compressed air which is introduced into the dryer at the lower end thereof from a blower 28 via a passage through heating element 25.

Figure 3:
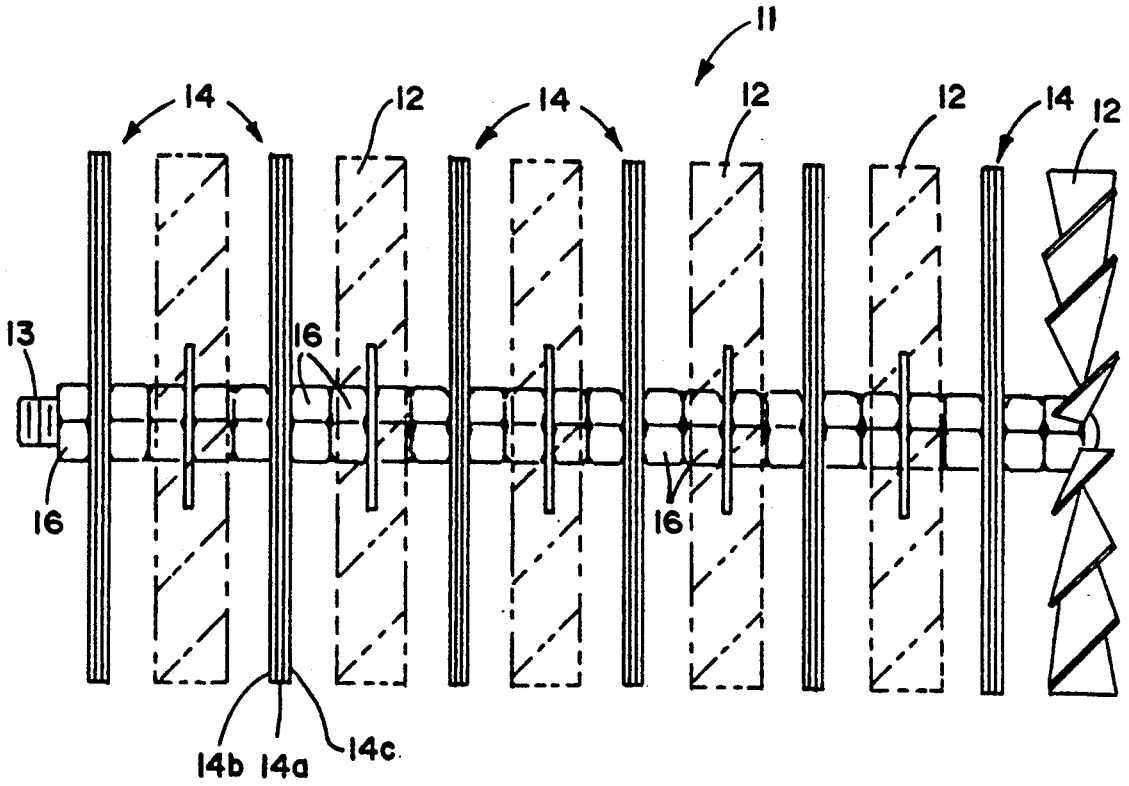
FIG. 3 is a detail showing one form of an air mixer used to mix the hot air introduced into the dryer of FIG. 1.

To avoid "hot spots" or localized overheating of air introduced to the dryer which might cause combustion of the tobacco sample in the dryer, air mixing means of any suitable construction are provided upstream of the hot air inlet to the dryer. A preferred construction of an air mixer 11 is shown in FIG. 3 and comprises a plurality of fixed, axially-spaced elements arranged in the passage between the blower 28 and the hot air inlet to the dryer. The mixing elements include non-rotatable air mixing blades 12 alternately positioned on a stationary shaft 13 with non-rotatable air mixing discs 14. The air mixing blades 12 are made of thin aluminum discs radially slit into sixteen 22.5° blades, each blade bent at a 45° angle to the plane of the disc. The air mixing discs 14 each comprise a thin aluminum disc **14*a* interposed between a pair of support discs 14*b*, 14*c* made of stainless steel wire mesh. In a preferred form of the air mixer, six air mixing blades are arranged on the shaft 13 alternately with six air mixing discs, each spaced apart by a pair of ¼-20 hexnuts 16 to form an air mixing assembly. Passage of heated air over the air mixing assembly 11** causes thorough mixing of the hot air so that "hot spots" are not created and the possibility of combustion of the tobacco sample is minimized.

Heated air from the air mixer 11 flows into the lower portion 19 of the dryer 20, upwardly past vanes **20*e* and through an annular air ring 20*f* in a lower stove-pipe region 20*a* of the dryer 20. Ring 20*f* is provided with a plurality of holes extending therethrough parallel to the axis of the dryer so as to create a region or space T of air turbulence in which the tobacco sample is circulated, dried and agitated in an efficient and rapid manner. The fluidization zone is located in and confined to the stove-pipe region 20*a* and the frusto-conical section 20*b* of the dryer 20. Preferably, the tobacco is heated to a temperature of from 280° to 300° F., which has been found sufficiently high to produce optimum results. The cooler air resulting from the heat transfer to the tobacco sample is exhausted from the dryer through screen 20*d* and exhaust tubing 30. Lighter tobacco fines smaller than the mesh of screen 20*d* which are produced as the sample is separated into smaller pieces by the heating and agitation of the fluidized bed are carried to the top portion 20*c* of the dryer and exhausted through tubing 30. A suitable receptacle 89 is positioned at the outlet end 31 of tubing 30 to receive any discharged tobacco fines or small lamina particles. To reduce heat loss, it is desirable to surround the heating element 25** and the dryer body with a suitable heat insulation material, such as fiberglass insulation or the like.

The fluidized bed dryer 20 is conveniently oriented with a vertical alignment, as shown in FIG. 1, such that all of the tobacco mixture consisting of lamina and stem portions gravitates to the bottom of the dryer as the heating/agitation step is performed and completed. If desired, one or more hot air inlet pipes **20*g* may be provided in the frusto-conical section 20*b* of the dryer for introducing periodic pulses of hot air at regular intervals, for example, every 5 seconds. Such hot air pulses create additional air turbulence and accelerate the drying and agitation of the clumps of tobacco in the sample 10**.

Figure 2:
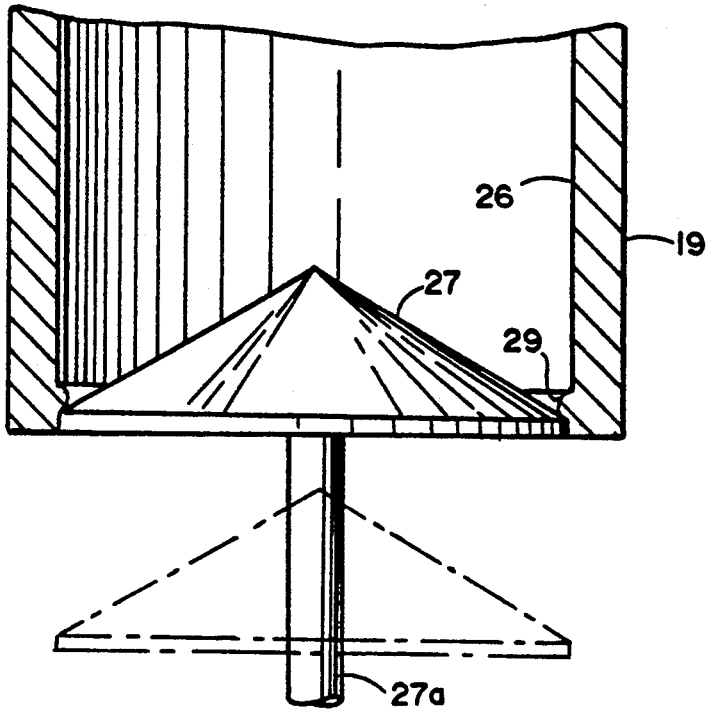
FIG. 2 is a sectional view of a portion of the apparatus of FIG. 1.

Referring to FIG. 2, within the lower portion 19 of the dryer (as viewed in FIG. 1), a removable seal is formed between the interior surface 26 of the cylindrical wall of lower section 19 and the circular edge of an inverted conical member 27. The conical member is supported by an integral shaft **27*a* affixed to the apex of the cone at the underside thereof and movable upwardly and downwardly along the cone axis. When fluidization is completed, the tobacco mixture, which is now retained atop conical member 27 at the bottom of the stove-pipe region 20*a* of the dryer 20, is discharged from the dryer by downward movement of shaft 27*a*, and thus member 27 (as shown in phantom lines of FIG. 2), through the operation of a suitable servomechanism or other conventional device (not shown). The conical member 27 is then moved upwardly against the stops formed by projections 29 to restore the seal between its edge and cylindrical surface 26. During discharge of the dried tobacco sample, the upward and downward movement of conical member 27 may be repeated several times, if desired, to assure that any clinging tobacco has been shaken loose from its upper surface and discharged from dryer 20**.

Referring again to FIG. 1, when the drying step is completed, the tobacco sample mixture consisting of the partially segregated lamina and stem portions is delivered into a vibratory separator 33.

As an alternative to weighing the entire tobacco sample at the outset of the process, i.e., prior to drying, the tobacco mixture may be weighed upon being discharged from the dryer and before delivery to the vibratory separator. However, it is important to note that if the tobacco sample is weighed after drying, discharge of tobacco fines and lamina during drying must be limited to assure an accurate initial sample weight. After such weighing, if this alternative is selected, the tobacco mixture is conveyed to the vibratory separator 33.

Except as will be indicated in the ensuing description, the separator 33 is of generally conventional design, such as one of those available from the Vibro-Energy line of separators produced by Sweco, Inc. of Los Angeles, Calif. In its conventional aspects, the separator comprises a screening device that vibrates about its center of mass. Vibration is effected by eccentric weights attached to upper and lower points on the motor shaft (not shown) of the separator. Rotation of the upper weight causes vibration in the horizontal plane, such that the sample to be screened moves across the screening device to the periphery of the separator. Rotation of the lower weight tilts the apparatus to cause vibration in the vertical and tangential planes. The angle of lead of the lower weight relative to the upper weight allows variable control of the spiral screening pattern of the material to be classified across the screening device from the center outwardly. As a consequence of this action, the fines constituting the smaller particles in the material fall through the screen and are discarded, leaving only the large portions of the material to be further utilized.

Figure 7:
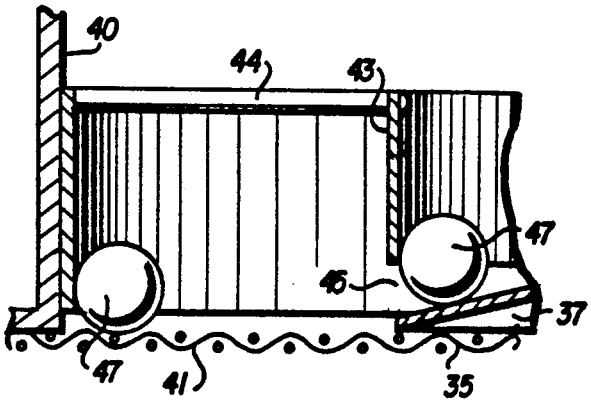
Figure 8:
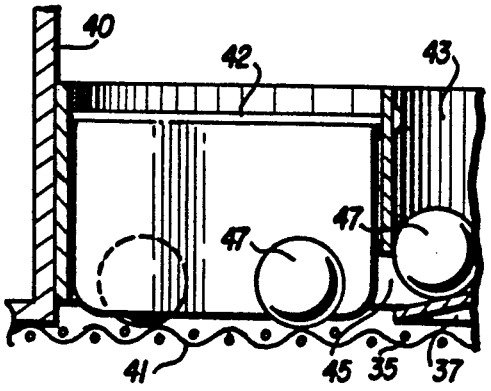

Portions of the interior of the separator 33 illustrating the modifications according to the present invention are shown in greater detail in the sectional views of FIGS. 4 through 8, inclusive. Referring to FIGS. 4–8 and the modifications to the separator according to the invention, the separator is provided with a single screen 35 having a suitable mesh number for allowing passage of the material to be classified of less than a predetermined size. An imperforate conical baffle 37 is centrally mounted on the screen by means of a bolt 39 affixed to the center of screen 35. Baffle 37 extends outwardly toward the cylindrical wall 40 of the upper section 33*a* of the separator 33 leaving an annular screening area 41 (FIG. 6) between the baffle periphery and cylindrical wall 40. The annular screening area 41 is further subdivided into six arcuate sections of approximately 60° each by means of vertical partitions 42. An annular ring 43 having an inside diameter approximately equal to the outside diameter of the conical baffle 37 is mounted to cylindrical wall 40 by supports 44. Ring 43 is concentrically disposed in the separator and is spaced above the baffle 37 so as to leave a gap 45 therebetween, as best seen in FIGS. 7 and 8.

A plurality of relatively hard elastomeric spheres or balls 47 are loosely distributed in five of the six arcuate sections of the annular screening area and optionally in the central section formed by the baffle 37 and ring 43. It may be desirable to distribute the elastomeric balls 47 in all of the six arcuate sections of the annular screening area to aid in breaking up the lamina. The balls 47 used in a preferred embodiment of separator 33 were purchased from Rotex, Inc. as their Model No. 2311. Each of the Model No. 2311 balls has a weight of about three ounces, is composed of white gum rubber, and has a durometer hardness of 40±5. The balls 47 are in accordance with the Rubber Manufacturer's Association Specification RMA-A3-F3-2016 or ASTM Standard 2AA420/Z1/Z2/Z3.

Figure 5:
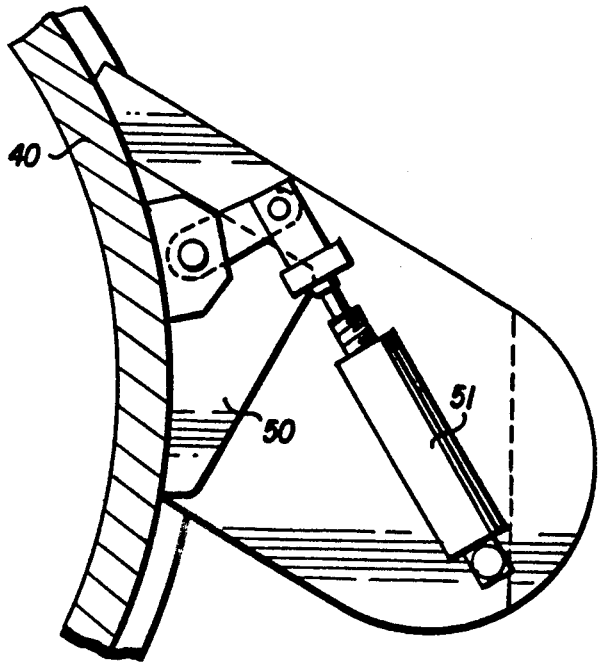
FIGS. 5 through 8 are details in section of parts of the apparatus shown in FIG. 4, taken along the lines 5—5, 6—6, 7—7 and 8—8, respectively.

An outlet chute 48 is provided in the cylindrical wall 40 adjacent one of the arcuate screen sections and an angled plate or diverter 49 extends from the ring 43 into the screen section adjacent the outlet chute 48 for a purpose to be hereinafter described. The outlet chute is closed by a flapper valve 50 which is automatically operated in a timed sequence by a pneumatic cylinder 51 or other suitable operator. The operating mechanism for the flapper valve 50 shown in FIG. 5 is designed to swing or pivot the valve 50 outwardly from the wall 40 and away from the center of the separator. If desired, an inwardly opening valve arrangement, for example, as shown in FIGS. 5*a* and 5*b* may be substituted for the flapper valve arrangement of FIG. 5.

Figure 5A:
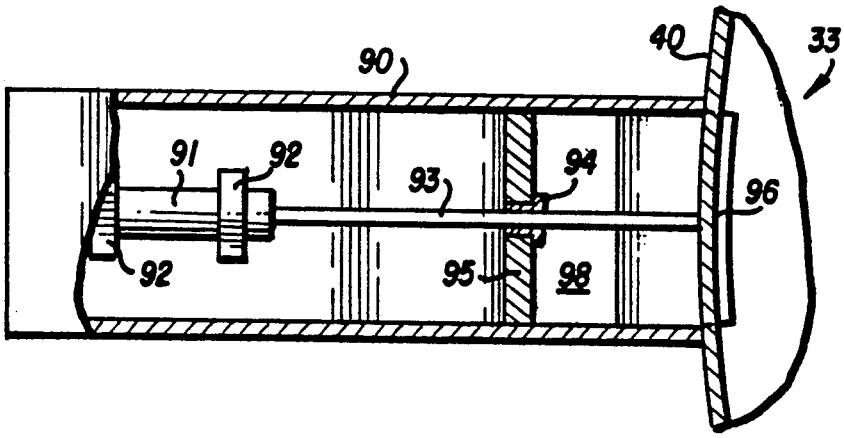
FIGS. 5*a* and 5*b* are fragmentary top and side views, respectively, partly in section, of an alternate construction of a door valve for the vibratory separator of FIG. 4 or FIG. 13.
Figure 5B:
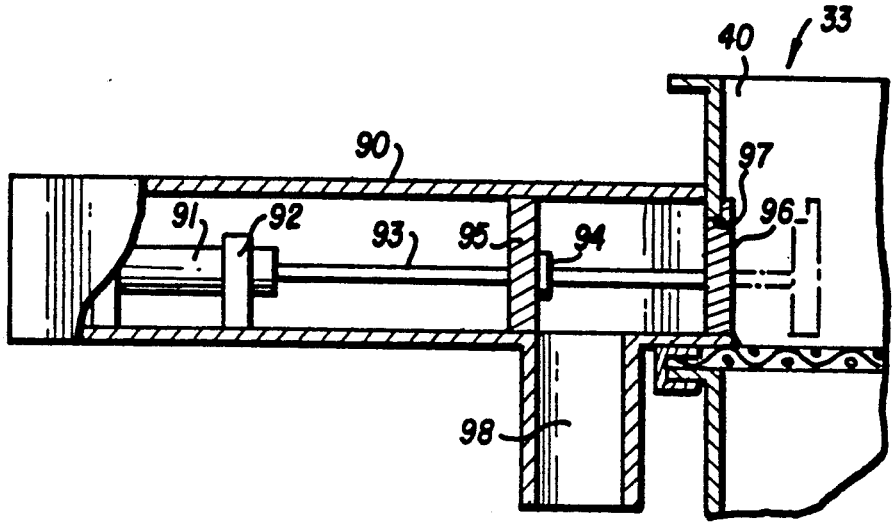
Figure 6:
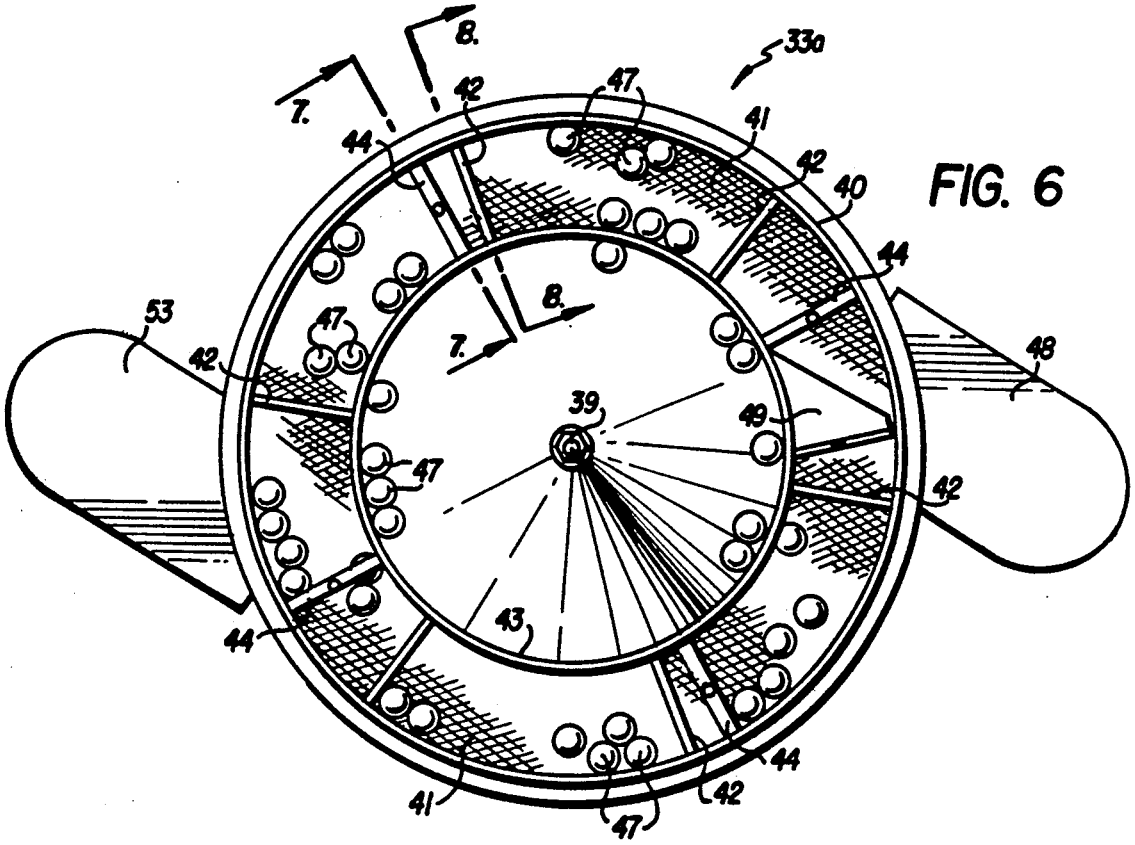

Referring now to FIGS. 5*a* and 5*b*, a generally rectangular housing 90 is shown mounted to the wall 40 of the vibratory separator 33 (or the wall 196 of the vibratory stem grader 180). Within housing 90, a pneumatic cylinder 91 or other suitable operator is mounted by means of supports 92 so that its actuating rod 93 extends radially toward the center of the separator 33. Rod 93 passes through a wall 95 and is slidably supported in a bushing 94 in wall 95. An arcuate door 96 is connected at the end of actuating rod 93 and is adapted to seal the outlet opening 97 in the wall 40 of separator 33 during operation thereof. After a predetermined time of operation of the separator, the pneumatic cylinder 91 is operated to move the rod 93 outwardly and unseat the door 96 from the outlet opening 97 as shown in phantom in FIG. 5*b*. The separator 33 continues its vibratory operation until the stem fractions pass through the opening 97 and are discharged through outlet chute 98. When the vibratory separator stops, the cylinder 91 retracts rod 93 to close and seal the door 96 in the opening 97 for the next operational cycle of the apparatus.

The lower section 33*b* of the separator 33 has a domed plate 52 which is connected at its periphery to the cylindrical wall 40 and at its center to bolt 39. An outlet chute 53 is connected to the cylindrical wall of the lower section and is arranged to discharge separated lamina and fines into the same receptacle 89 into which the tobacco fines from outlet 31 of tubing 30 discharge (see FIG. 1).

The separator 33 is programmed to commence its vibratory movement when the dried tobacco sample is discharged from the valve 19 at the lower end of the dryer 20 onto the conical baffle 37 of the separator. As the tobacco lamina and stem fractions spread over the baffle, the vibratory motion of the separator and the outward slope of the baffle cause the tobacco sample to migrate or to be directed outwardly toward the annular screening area 41. At the same time, the elastomeric balls or spheres 47 (if used in the central area of the ring 43) oscillate up and down by reason of the vertical vibratory motion of the separator and act upon the tobacco sample with a beating action to thresh the lamina from the stem and reduce the particle size of the lamina for screening. Eventually, the entire sample migrates to the screening area 41 where the balls 47 in the arcuate sections further beat and reduce the particle size of the lamina so that the lamina particles and fines pass through the screen 35 into the lower section 33*a* of the separator. As will be understood from the ensuing description, the mesh size of screen 35 should be selected to allow passage therethrough of these unwanted (for purposes of the invention) lamina portions of the tobacco sample while the stem portions are retained upon the screen.

The balls 47 are maintained substantially uniformly distributed about the screening area 41 by the partitions 42 which prevent the balls from "bunching up" or collecting in one location. In the embodiment shown, six balls are provided in five of the six arcuate screening sections although a greater or lesser number of balls may be used and, as previously mentioned, balls may be provided in all six arcuate sections. Vibration of the separator 33 causes the lamina and stem fractions of the tobacco sample to travel clockwise around the screening area 41 (as viewed in FIG. 6) and to pass beneath the partitions 42. After a predetermined period of operation of the separator as determined by testing, all or substantially all lamina particles have been separated from the stem fraction and have passed through screen 35 into the lower section 33*b*. During this period of operation the flapper valve 50 (or door 96) remains closed. When only the stem fraction remains on the screen 35, however, the valve 50 is opened in a timed sequence to permit the stem portions to be discharged with the aid of diverter 49 through the outlet chute 48 (or 98).

Figure 4:
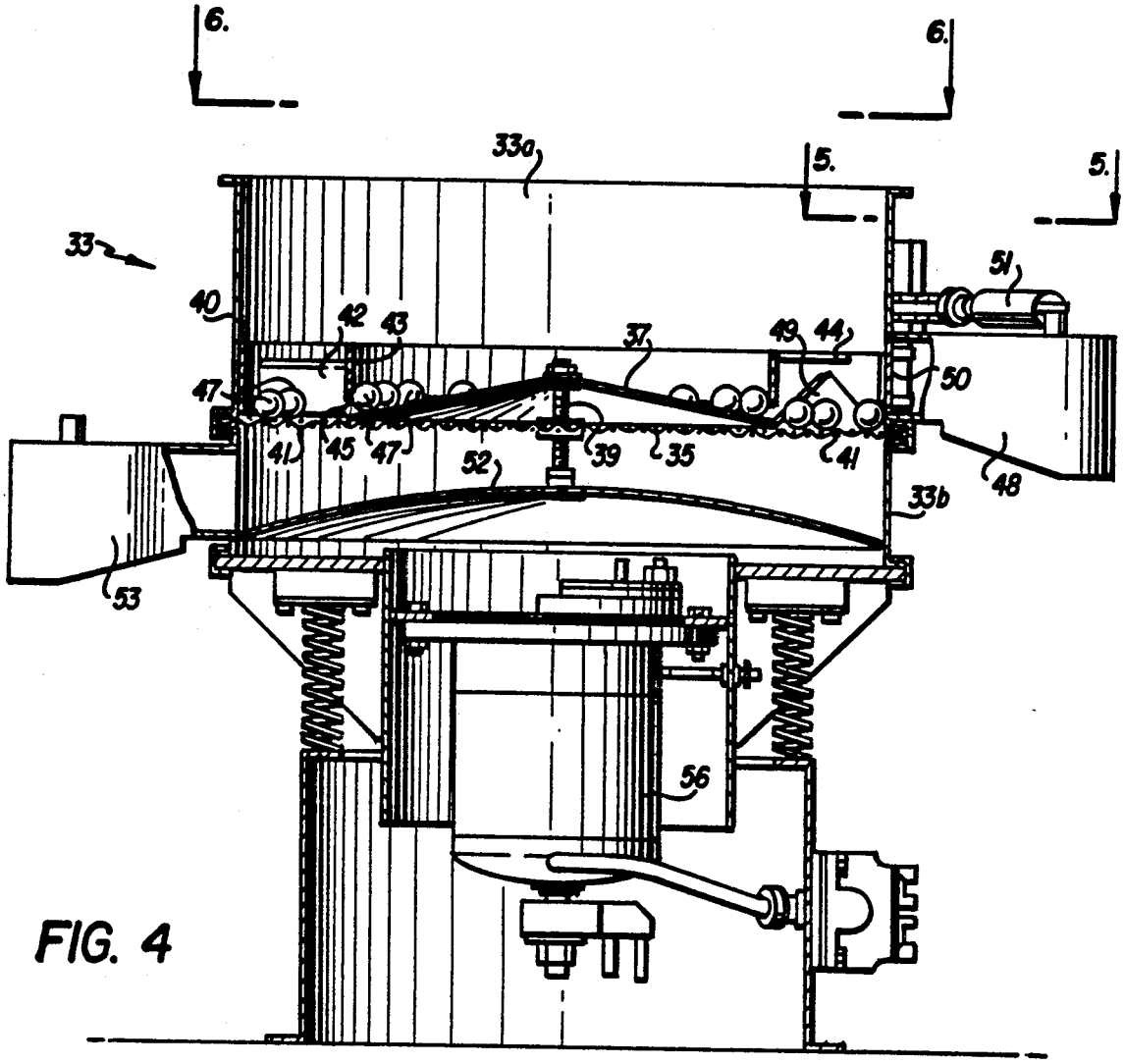
FIG. 4 is a side sectional view of another portion of the apparatus of FIG. 1.

To assist in preventing the balls 47 in the other arcuate sections from being ejected from the separator when the vibration cycle is stopped, it is desirable that a rapid cessation of that cycle be accomplished. To that end, it is preferable that an electric brake be employed, for example, on the bottom shaft of the motor 56 (FIG. 4).

The lamina particles and fines which have passed through screen 35 are deposited on domed plate 52 which is also subjected to vibration. The combination of the domed shape and vibration of plate 52 causes the lamina particles and fines to spiral outwardly in a clockwise direction as viewed in FIG. 6 so as to be discharged through chute 53 into a waste receptacle 89.

The stem portions discharged from the separator 33 enter a grader 60 (FIG. 1) which undergoes vibration as a consequence of its coupling to a vibration motor 62. This portion of the apparatus is shown in greater detail in FIGS. 9 and 10. The surface of the grader onto which the stem portions are discharged is inclined downwardly away from separator 33 as a result of the asymmetric mounting of the grader on a pair of shock absorbers 64,66.

The portion of the grader 60 disposed directly beneath the outlet chute 48 comprises a screen section 68 which screens out all remaining tobacco fines. Such fines pass through screen section 68 and fall onto the inclined bottom plate 70 of the grader where they move down the inclined surface of plate 70 and fall through a discharge chute 72 into a receptacle 74.

The upper inclined surface of the grader 60 is provided with a set of parallel, longitudinally extending shallow grooves 76, which merge at the downstream ends thereof into a slotted plate. As the grader vibrates, the stem portions being fed into the device from separator 33 become aligned along the axes of the grooves, and thereby move down the grooves in parallel alignment toward the outlet 78 of the grader. As an alternative to the use of a screen in the first stage of vibratory separator 33 described earlier herein, a slotted plate similar to that in grader 60 may be used for an initial separation of the stems in that device.

At the lower end of the incline at the downstream end of the grooves 76 the slotted plate of grader 60 is formed with an array of interengaging fingers 80,83 arranged such that the spacing from one another provides a mesh or grate having openings of a given size. The spacing between fingers is designed to allow stem portions below a predetermined size to fall through the openings and to move to the outlet 78, as a result of the vibrating motion of the grader, where they are discharged onto the weight tray 81 of a scale 82 (FIG. 1).

After the stem portions of this first range of sizes (at and below the size of the openings or lateral spaces formed between the interengaging fingers) are weighed, the stem portions on scale 82 are removed from the tray 81 by a vacuum tube 84 which is pivoted downwardly over the tray 81 by a pneumatic operator 86. Valve 21 is opened to vacuum tube 84 via vacuum line 85 and vacuum pump 22 is energized to draw the first, smaller stem portion from the tray 81 and deposit it in a waste receptacle 88 positioned below the discharge outlet 22*a* of the vacuum pump.

Figure 9:
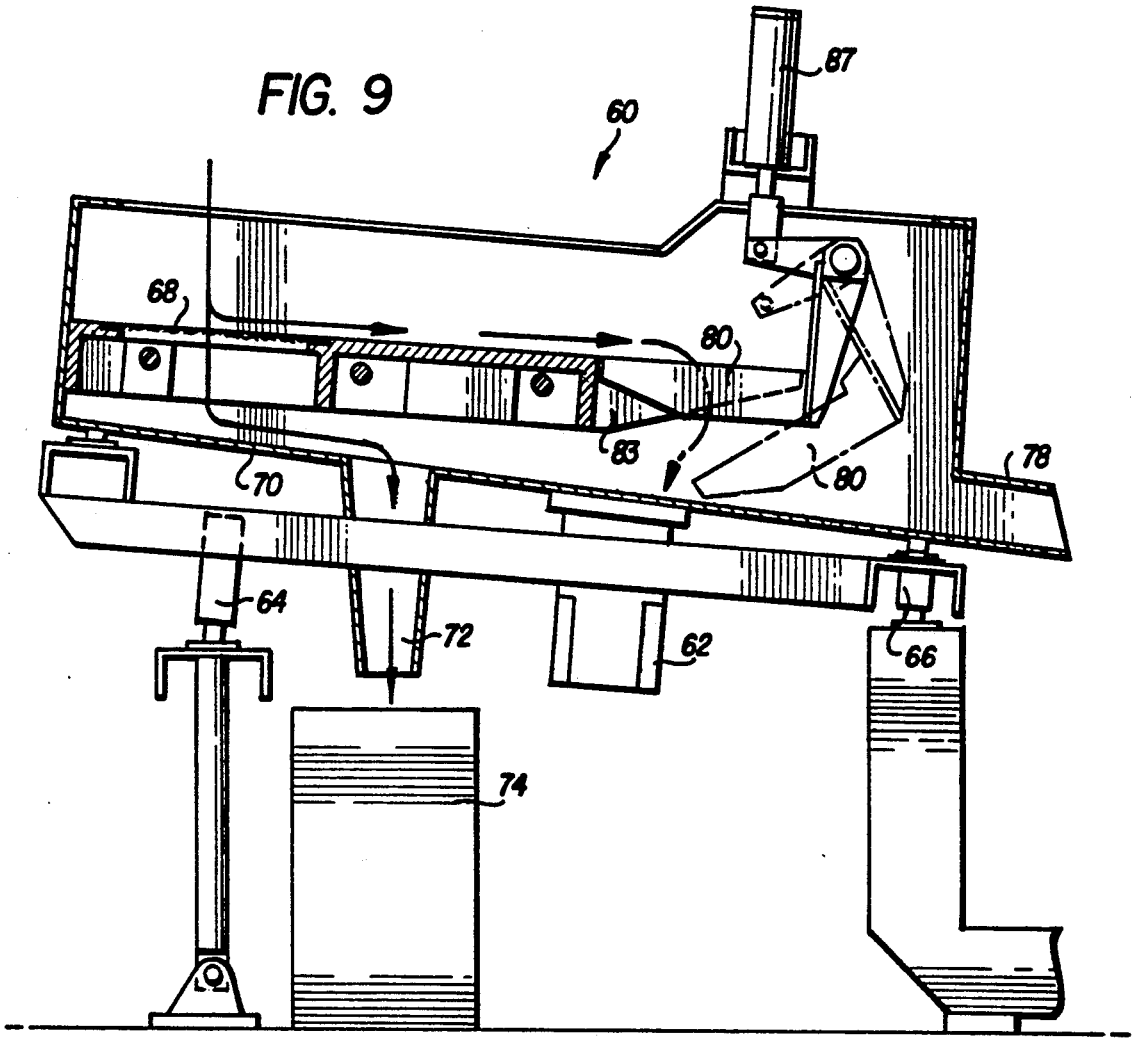
FIG. 9 is a side sectional view of another portion of the apparatus of FIG. 1.
Figure 10:
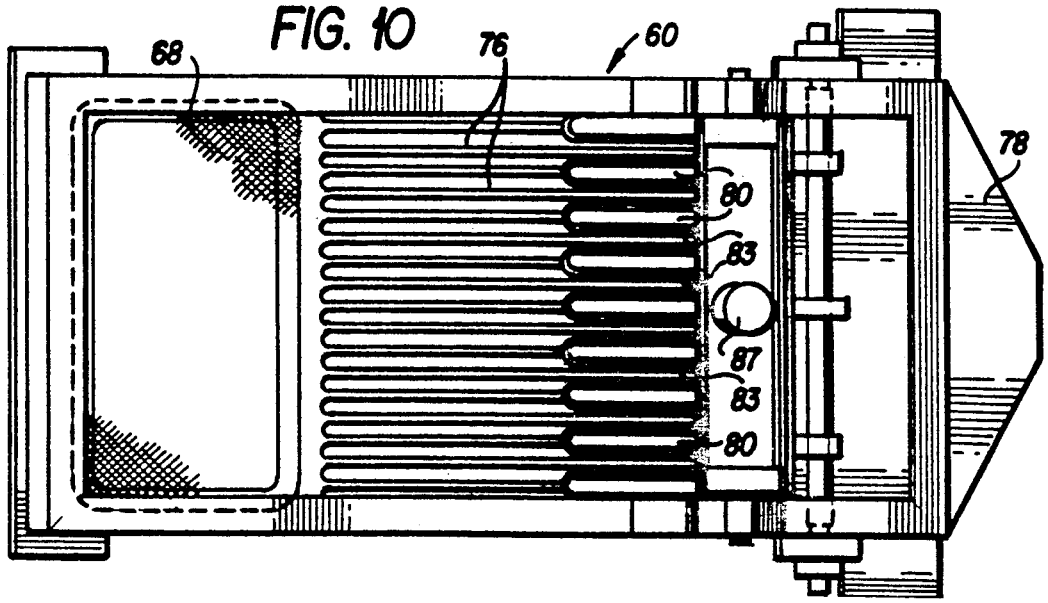
FIG. 10 is a top view of the portion of the apparatus shown in FIG. 9.

After the first portion of the stems is removed from tray 81, the interengaging fingers 80,83 are spread as shown in phantom lines in FIG. 9 by a pneumatic operator 87 to allow the stem portion of the next size range to fall through the openings. In the preferred embodiment, only two size ranges of stem are measured. The larger stem portion is then discharged from grader outlet 78 into the tray 81 of the scale 82, in the same manner as described above for the smaller stem portion, for weighing. After weighing, the second or larger stem portion is removed from the tray 81 by the vacuum system in the same manner as the smaller stem portion is removed.

Scale 82 is preferably of the electronic type to produce a digital signal representative of the weight of the object in the tray 81. The readings are stored in an electronic memory and the measured weights of the two stem fractions are compared against the stored weight of the original sample, for the determination of relative stem content, by size, of the sample. Although the determination is made as a measure of relative weights, it will be understood that other suitable measures may be used, such as volume. The electronic system by which the determination is made from the scale readings is adapted to include a correction factor to account for the assumed moisture content, for example 13%, in the original cored tobacco sample.

Figure 11:
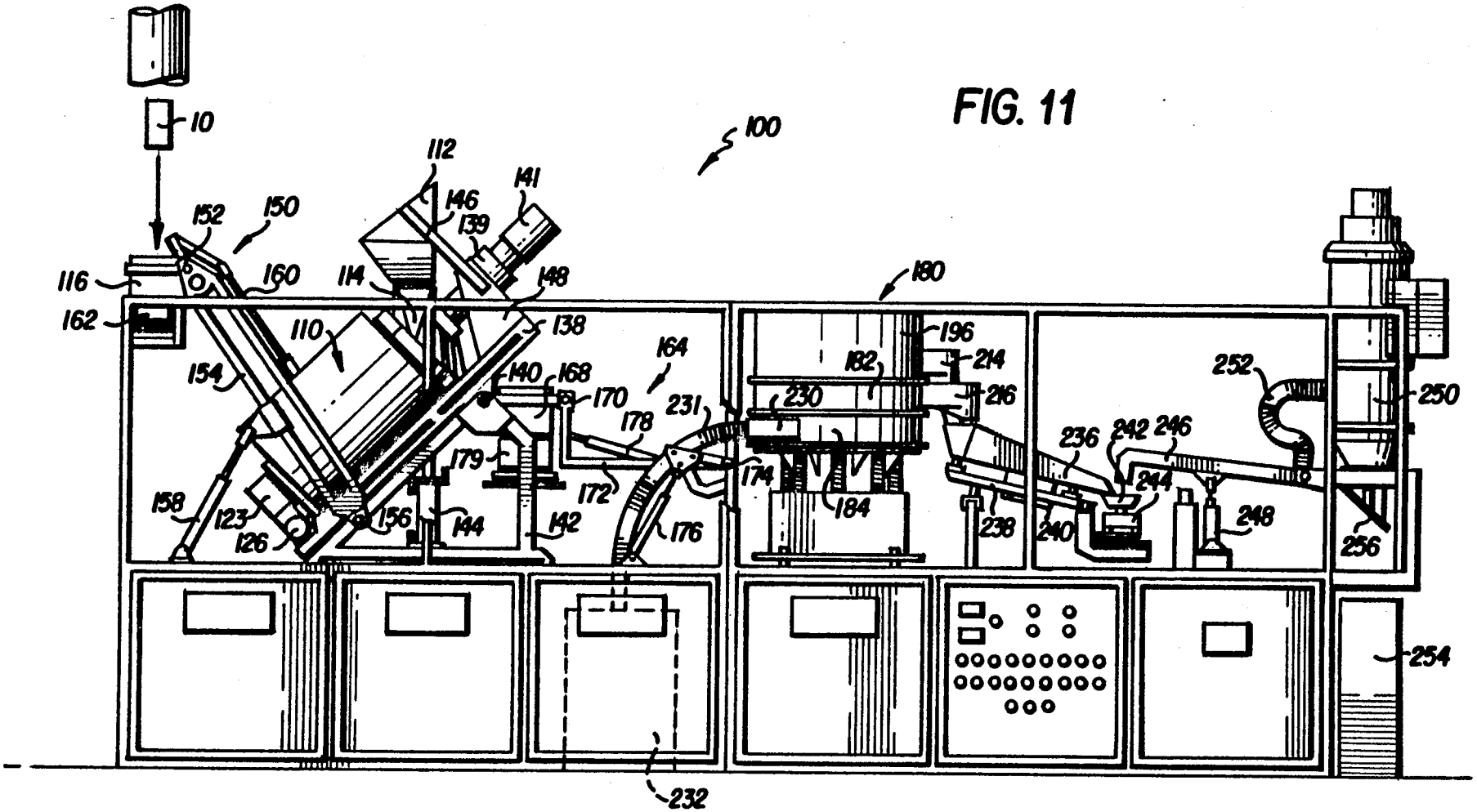
FIG. 11 is a side elevational view of the apparatus according to the second preferred embodiment of the present invention.

The second embodiment of the present invention is shown in FIG. 11, and is designated generally by reference numeral 100. A tobacco sample 10 is introduced into an upwardly inclined rotary dryer 110 through a hopper 112 and funnel 114 arranged at the upwardly inclined end of the drum dryer by means of a pivotable receptacle 116 or any other suitable mechanism. As in the first embodiment, the sample 10 may be partially separated into pieces by any conventional method before delivery to the dryer 110.

Figure 12:
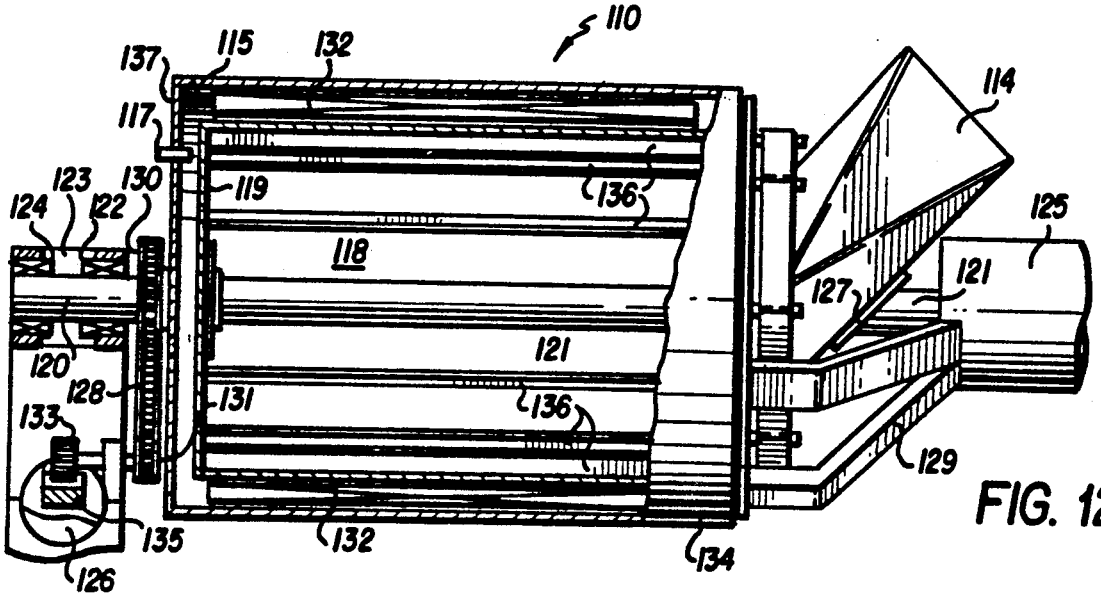
FIG. 12 is a side elevation view, partly in section, of the rotary drum dryer of the second embodiment of the invention.

Referring to FIG. 12, it will be seen that drum dryer 110 is similar in construction to an ordinary clothes dryer. Dryer 110 comprises a cylindrical drum 118 having a closed end 119 and an open end adjacent funnel 114. The drum 118 is rotatably driven about its longitudinal axis by a variable speed motor 141 (FIG. 11) connected through a gear reducer 139 to a drive shaft 121. As shown in FIG. 12 drive shaft 121 is affixed to and extends from the closed end 119 of the drum through the axial length of the drum and the open end thereof, through a sealed bushing 127 in the funnel 114 and through a bearing (not shown) mounted in bearing block 125. Although the connection between the drive shaft 121 and the end 119 of drum 118 is sufficiently rigid to support the drum concentrically on the shaft, if desired, the open end of the drum may be rotatably supported in the housing 134 of dryer 110, for example, by anti-friction ball bearings or the like.

Heating elements 132 are spaced around the cylindrical drum 118 to heat the interior of the drum. The dryer 110 has an outer housing 134 which is preferably insulated to minimize radiation of heat from heating elements 132 to the surrounding environment. Other means for heating the interior atmosphere of the drum 118 may be used, such as, for example, introducing heated air from a separate source into the drum interior or embedding the heating elements in the cylindrical wall of the drum 118 which may be made of a ceramic material.

Any suitable means for measuring and controlling the internal temperature of the drum may be employed. Preferably, a thermocouple 117 is located in the space 115 between the closed end 119 of the drum and the closed end cover 137 of the housing 134. Thermocouple 117 is connected to any conventional temperature control system for supplying electrical energy to heating elements 132 and for maintaining a selectable internal temperature in the drum. Other means may be employed for measuring and controlling the internal drum temperature, such as an infrared thermometer, which is "aimed" at the drum interior through the funnel 114 at the open end of the drum. Such an infrared thermometer may be used as the temperature sensor in lieu of the thermocouple 117 mounted in the housing end wall 137.

As shown further in FIG. 12, a stub shaft 120 is rigidly connected to the closed end cover 137 of the housing 134. Shaft 120 is rotatably mounted in bearings 122,124 in bearing block 123 and is rotatable relative to the drum 118 about the same rotational axis as the drum. Funnel 114 is mounted to the opposite end of the housing 134 for rotation therewith. Bearing block 125 is likewise rotatable with the housing 134 by means of the spider support 129. Shaft 120 is rotated through a limited angle by means of a drive chain 128 and sprocket 130 which are driven by a gear 131 connected to the pinion 133 of a rack 135. Rack 135 is guided for movement along its longitudinal axis and is moved back and forth along such axis by the piston rods of a pair of double-acting air cylinders 126 (only one shown) in a known manner. The above-described arrangement is operable to rotate the drum housing 134 together with the funnel 114 through a limited (180°) angle.

The interior surface of the drum is provided with a plurality of equi-angularly spaced vanes 136 which are fixed to and rotate with the drum. After the tobacco sample 10 is introduced into the dryer 110 via the funnel 114, the drum 118 is pivoted to the horizontal and rotated as its interior is heated with heating elements 132 to the desired temperature of from 280° to 300° F. to remove the moisture and volatile compounds from the tobacco sample. Simultaneously with the heating and drying, the clumps of the tobacco sample are broken up and ruptured by collisions with the rotating vanes 136 for a predetermined and controlled period of time sufficient to reduce the tobacco sample to a loose mixture of lamina and stem portions. After the heating/agitating step is completed, the dryer 110 is rotated through 180° so that the funnel 114 is disposed in a downward orientation. The dryer 110 is then tilted upwardly to discharge the heated and agitated sample through the funnel 114 as described in greater detail hereinafter in connection with FIGS. 15–20.

Referring again to FIG. 11, the dryer 110 is shown in its inclined position for receiving a tobacco sample to be heated and agitated. Carriage 138 is pivotally mounted by pivot means, such as pins 140, to a support frame 142 so as to be pivotable through approximately 90° clockwise from the position shown in FIG. 11. One or more fluid actuators, such as a pneumatic operator 144, are mounted between the frame 142 and the dryer carriage 138 to pivot the carriage and the dryer about the axis of pivot pins 140 to predetermined inclinations at predetermined times in the sequence of operation of the apparatus as more fully described hereinafter.

Hopper 112 is mounted to the supports 148 for the motor 141 and gear reducer bearing block 139 by means of stanchions 146 and thus remains in a fixed position relative to the carriage 138. A tobacco sample transfer mechanism 150 comprises receptacle 116 pivotably mounted by pins 152 to a pair of arms 154 which are, in turn, pivotably mounted by pins 156 to the frame 142 on opposite sides thereof. Actuators, such as pneumatic operators 158 and 160, are used to position the receptacle 116 in position over the hopper 112 for discharge of the tobacco sample 10 into the drum 118 via the hopper and funnel 114.

As described above in connection with the first embodiment of the invention, the tobacco sample 10 may be weighed prior to transfer to the apparatus 100 of FIG. 11. Also for that purpose, an electronic scale 162 may optionally be provided beneath receptacle 116 for weighing the sample 10 cored from the baled tobacco prior to any drying thereof. The output of the scale 162 representing the "wet" weight of the sample 10 is stored in a suitable electronic memory.

After the tobacco sample has been thoroughly dried (for example, to a 0% moisture content) and agitated to break up the clumps of tobacco that may remain in the tobacco sample, the dried sample is transferred via a second articulated transfer mechanism 164 to a vibratory stem grader 180 downstream of the dryer. Transfer mechanism 164 comprises a receptacle 168 pivotably mounted by pins 170 between a pair of L-shaped arms 172 which are, in turn, pivotally mounted to a horizontal shaft 174. Pneumatic operators 176,178 are connected to the transfer mechanism 164 and are operable to move the receptacle 168 from its tobacco sample receiving position shown in FIG. 11 to its discharge position above the stem grader 180.

Another electronic scale 179 similar to optional scale 162 is provided beneath the receptacle 168 to weigh the tobacco sample 10 after completion of the drying step. The output of scale 179 represents the "dry" weight of the sample and is also stored in the aforesaid electronic memory. Rather than using an assumed moisture and volatile content, such as the standard 13% figure, the actual moisture and volatile content may be calculated from the difference in weight of the sample 10 before and after the drying step. Thus, the difference between the "wet" and "dry" weights of the stored weight signals from the scales 162 and 179 represents the actual moisture and volatile content of the tobacco sample. If scale 162 is not used, the dry weight from scale 179 is used to calculate stem content only.

Figure 14A:
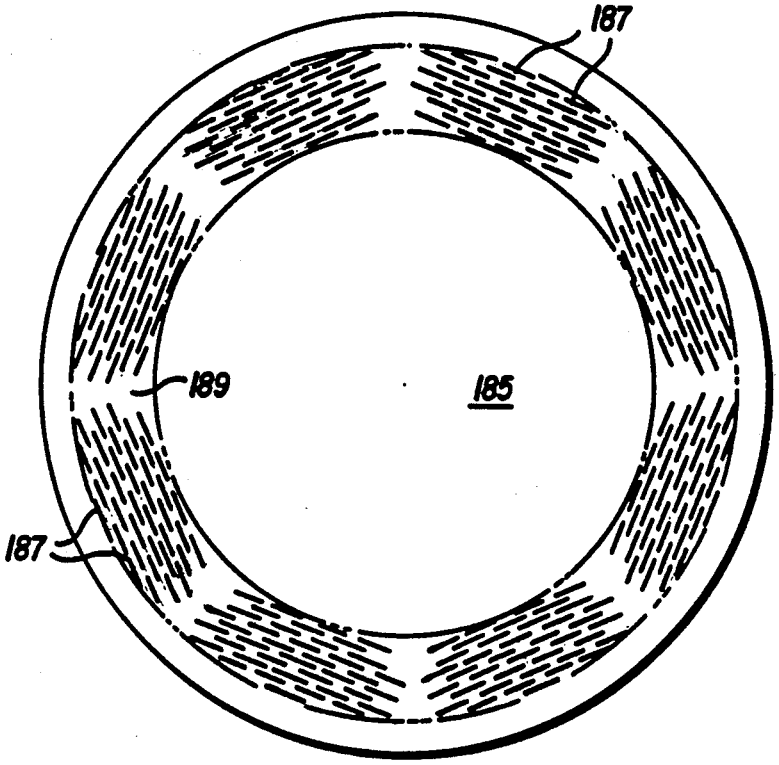
FIG. 14*a* is a top view of a slotted plate used in an alternative embodiment of the vibratory stem grader of FIG. 14.
Figure 13:
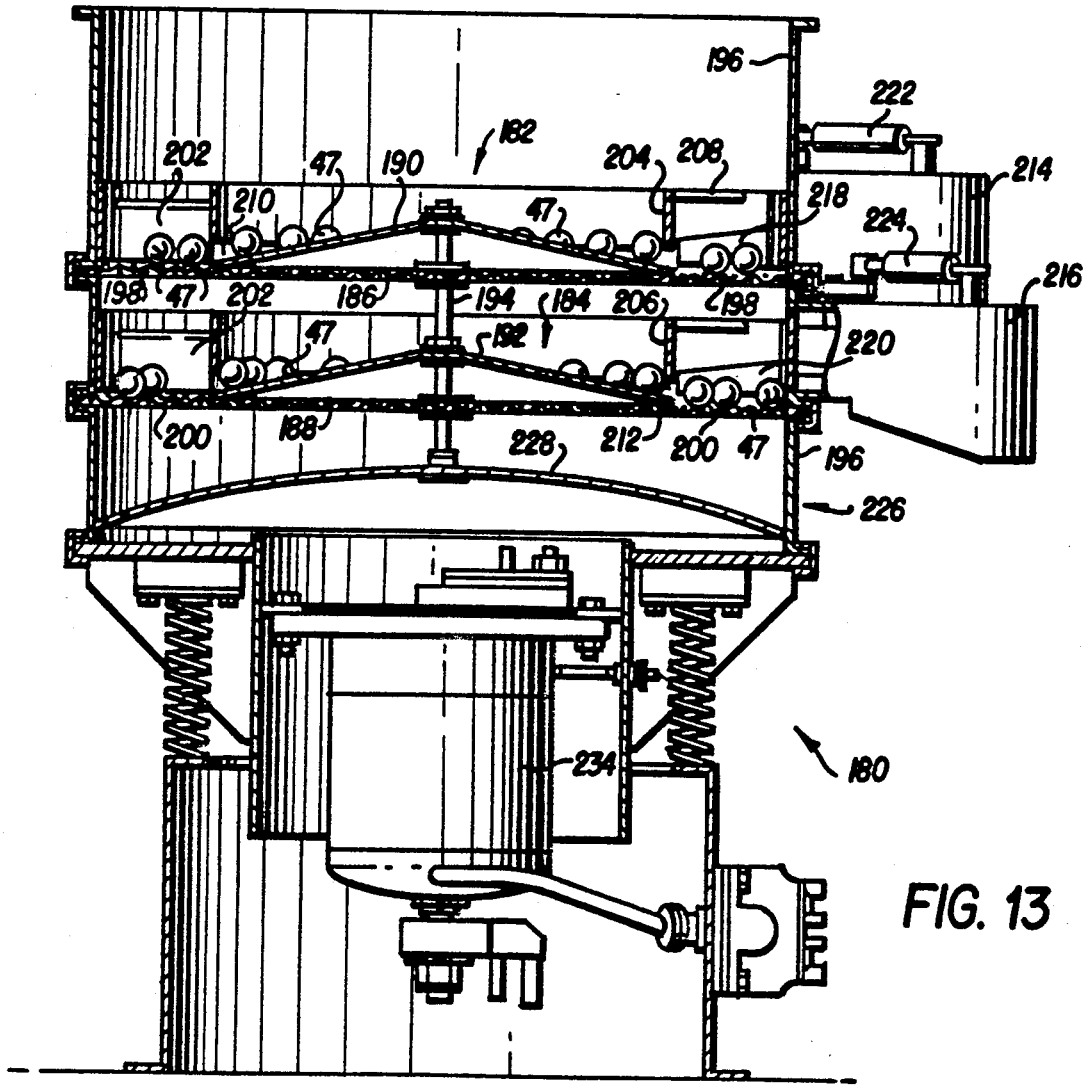
FIG. 13 is a side sectional view of the vibratory stem grader apparatus of the second embodiment of the invention.
Figure 14:
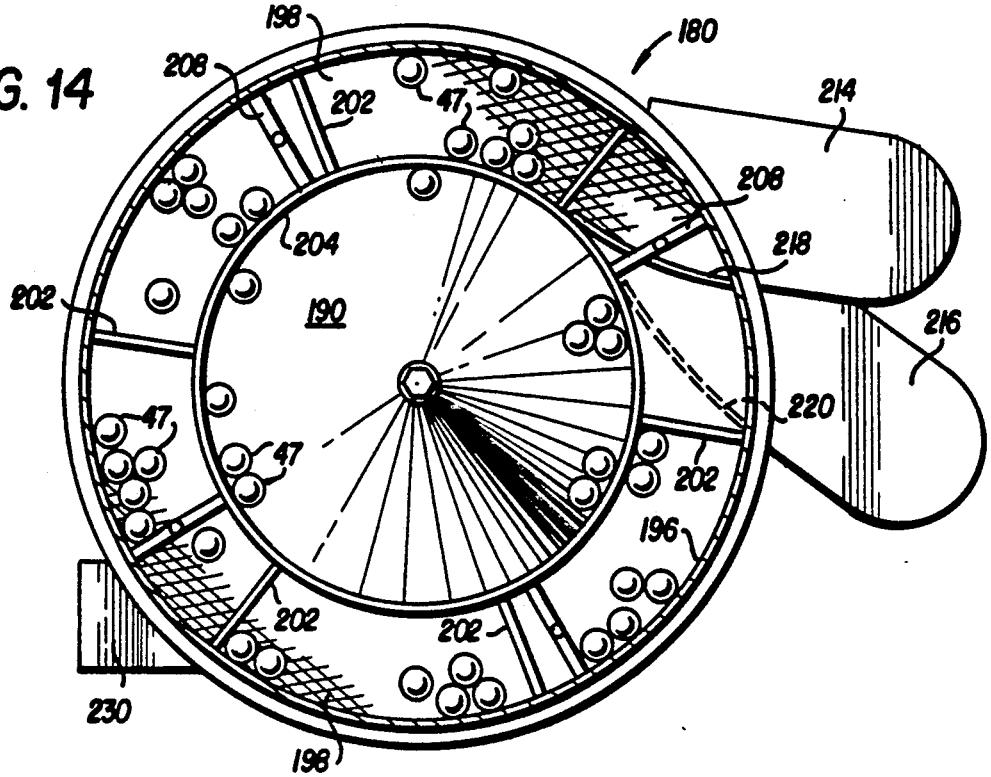
FIG. 14 is a top view of the stem grader apparatus shown in FIG. 13.

FIGS. 13 and 14 illustrate in cross-section and top view, respectively, the stem grader 180 which is similar in many respects with the vibratory separator 33 of the first preferred embodiment shown in FIGS. 4–8. The main difference between the stem grader 180 and the vibratory separator 33 being the addition of a second grading stage for the stem portions of the tobacco sample. Whereas both large and small size stem portions were separated from the tobacco lamina and discharged from the outlet chute 48 of vibratory separator 33, in the stem grader of the second embodiment of the invention, each size of the stem portion is separated and discharged independently from the stem grader for weighing.

Generally speaking, the structure and operation of the stem grader 180 corresponds to the structure and operation of the vibratory separator 33, such structure and operation being briefly described for the sake of completeness. The vibratory stem grader 180 is a modified version of a generally conventional design available from the Vibro-Energy line of separators produced by Sweco, Inc. of Los Angeles, Calif. and is caused to vibrate in the manner described above for vibratory separator 33.

Referring to FIGS. 13 and 14 and the modifications of the stem grader 180 according to the invention, the grader comprises two separation stages 182,184 each provided with a screen 186,188 having suitable mesh numbers for classifying two predetermined sizes corresponding to the sizes of the large and small stem portions of the tobacco sample to be determined. For example, screen 186 allows passage of the tobacco lamina and fines as well as the smaller size stem portion, but does not allow passage of the larger size stem portion. Screen 188 allows passage of the tobacco lamina and fines, but does not allow passage of the smaller stem portion.

Imperforate conical baffles 190,192 are centrally mounted on screens 186,188, respectively, by means of an elongated bolt 194 affixed to the center of each screen. Baffles 190,192 extend outwardly toward the cylindrical wall 196 of the grader 180 leaving an annular screening area 198 (FIG. 14) and 200 between the periphery of each baffle and the cylindrical wall 196.

Annular screening areas 198,200 are further subdivided into six arcuate sections of approximately 60° each by means of vertical partitions 202. Annular rings 204,206 each having an inside diameter approximately equal to the outside diameter of the respective conical baffle 190,192 are mounted to cylindrical wall 196 by supports 208. Annular rings 204,206 are concentrically disposed in a respective separation stage 182,184 spaced above a respective baffle 190,192 so as to leave gaps 210,212 between the rings and baffles in the manner shown in the details of FIGS. 7 and 8 of separator 33.

Referring now to FIG. 14*a*, in lieu of the mesh screen 186 in the upper separation stage 182 of the grader 180, such stage may be provided with a circular slotted plate 185 having a plurality of substantially rectangular slots 187 disposed therein in an annular area 189 corresponding to the annular screening area 198 shown in FIGS. 13 and 14. In a preferred arrangement, the slots 187 are formed in eight groups each spaced apart about 45° with the slots in each group disposed in a pattern along a plurality of lines tangential to the boundaries of the annular screening area 189 and in a staggered arrangement as shown. The slots 187 are preferably rectangular in shape with a slot length greater than the slot width, the specific dimensions of the slots in the plate 185 being readily determined experimentally depending on the sizes of the stems of the large stem portions to be classified by the slotted plate.

The arrangement of slots as shown has been found to maximize the total number of rectangular slots that may be formed in the available annular area. In an actual embodiment of a slotted plate made according to FIG. 14*a*, each group of slots comprises thirty-nine (39) slots for a total of three hundred twelve (312) slots having a width of 3/32 inch and a length of 1¼ inches in an annular area of 15⅜ inches inside diameter and 20¼ inches outside diameter. It is also contemplated according to the invention that a slotted plate similar to slotted plate 185 may be substituted for the screen 188 in the lower separation stage 184 of the grader 180 to classify the smaller stem portion.

A plurality of relatively hard elastomeric spheres or balls 47 are loosely distributed in five of the six arcuate sections formed by the baffles 190,192 and rings 204,206. The balls 47 used in both preferred embodiments of separator 33 and grader 180 were purchased from Rotex, Inc. as their Model No. 2311. Each of the model No. 2311 balls has a weight of about three ounces, is composed of white gum rubber, and has a durometer hardness of 40±5. The balls 47 are in accordance with the Rubber Manufacturer's Association Specification RMA-A3-F3-2016 or ASTM Standard 2AA420/Z1/Z2/Z3.

Outlet chutes 214,216 are provided in the cylindrical wall 196 adjacent one of the screen sections of a respective separation stage. Curved diverters 218,220 extend from a respective annular ring 204,206 into the screen section adjacent the respective outlet chute 214,216. Diverters 218,220 differ from the angled plate diverter 49 used in the first embodiment in that the diverters 218,220 comprise a wedge-like bar having a curved profile when viewed from above as seen in FIG. 14, for example. Each outlet chute is closed by a flapper valve similar to that shown in FIG. 5 which is automatically operated in a timed sequence by a respective pneumatic cylinder 222,224 or other suitable operator.

Lower section 226 of the grader 180 has a domed plate 228 which is connected at its periphery to the cylindrical wall 196 and at its center to bolt 194. An outlet chute 230 (FIG. 14) is connected to the cylindrical wall of the lower section 226 and is arranged to discharge separated lamina and fines through a flexible tube 231 into a receptacle 232 (FIG. 11) for discarding or recycling.

The grader 180 is programmed to commence its vibratory movement when the dried and agitated tobacco sample is discharged from the receptacle 168 of transfer mechanism 164 onto the conical baffle 190 of the upper or first separation stage 182. As the tobacco lamina and stem fractions spread over the baffle, the vibratory motion of the grader and the outward slope of the baffle cause the tobacco sample to migrate outwardly toward the annular screening area 198. At the same time, the elastomeric balls or spheres 47 (if used in the central area of the rings 204,206) oscillate up and down by reason of the vertical vibratory motion of the grader 180 and act upon the tobacco sample with a beating action to thresh the lamina from both the larger and smaller stem portions and reduce the particle size of the lamina for screening. Eventually, the entire sample migrates to the screening area 198 where the balls 47 in the arcuate sections further beat and reduce the particle size of the lamina so that the lamina particles pass through the screen 198 into the lower or second separation stage 184.

As will be understood from the ensuing description, the mesh size of screen 186 should be selected to also allow passage therethrough of the smaller size stem portion as well as the unwanted (for purposes of the invention) tobacco fines and lamina portions of the sample while the larger size stem portion is retained upon the screen 186. Similarly, the mesh size of screen 188 should be selected to allow passage therethrough of the unwanted tobacco fines and lamina while the smaller size stem portion is retained upon the screen 188. The balls 47 in the lower separation stage 184 perform the same beating and particle reducing functions as the balls 47 in the upper stage 182.

The balls 47 are maintained substantially uniformly distributed about the screening areas 198,200 by the partitions 202 which prevent the balls from "bunching up" or collecting in one location. In the second embodiment, six balls are provided in five of the six arcuate screening sections although a greater or lesser number of balls may be used. Vibration of the grader 180 causes the lamina and stem fractions of the tobacco sample to travel clockwise around the screening areas 198,200 (as viewed in FIG. 14) and to pass beneath the partitions 202. After a predetermined period of operation of the grader as determined by testing, all or substantially all lamina particles have been separated from the two stem fractions and have passed through screens 186,188 into the lower section 226.

The lamina particles and fines which have passed through screens 186,188 are deposited on domed plate 228 which is also subjected to vibration. The combination of the domed shape and vibration of plate 228 causes the lamina particles and fines to spiral outwardly in a clockwise direction as viewed in FIG. 14 so as to be discharged through chute 230 into a waste receptacle 232 via tube 231.

During the period of vibratory operation, the flapper valves 50 of each outlet chute 214,216 remain closed. When only the large stem fraction remains on the screen 198 and only the small stem fraction remains on the screen 200, the valves of the outlet chutes are opened in a staggered timed sequence to permit the two stem portions to be discharged with the aid of curved diverters 218,220 through the respective outlet chutes 214,216. It should also be understood that the door 96 and door operating mechanism shown in FIGS. 5*a* and 5*b* could be substituted for each of the flapper valves 50 and their respective operating mechanisms.

To assist in preventing the balls 47 in the other arcuate sections from being ejected from the first stage 182 when the vibration cycle is stopped, it is desirable that a rapid cessation of that cycle be accomplished. To that end, it is preferable that an electric brake be employed, for example, on the bottom shaft of the motor 234 (FIG. 13).

As previously mentioned, the two stem portions are discharged from the outlet chute 214 into an inclined converging chute 236 which is resiliently mounted on a support 238. An air-operated vibratory motor 240 mounted to the bottom of chute 236 vibrates the chute and causes the larger stem portion to gravitate rapidly down the chute 236 where it is discharged onto weigh tray 242 of a weighing scale 244. After the larger stem portion is weighed on scale 244, it is removed from the weigh tray 242 by a vacuum pipe 246 which is pivoted downwardly over the tray 242 by a pneumatic operator 248. Vacuum pipe 246 is connected to vacuum pump 250 by a vacuum line 252 so that when vacuum pump 250 is energized the large stem portion is drawn from the tray 242 and deposited in a waste receptacle 254 positioned below the discharge outlet 256 of the vacuum pump.

Following the weighing and removal of the large stem portion from the weight tray, the valve of the outlet chute 216 of the second stage is opened by operator 224 to discharge the smaller stem portion through outlet 216 onto the inclined chute 236 and into the weight tray 242 for weighting and removal in the same manner as described above for the large stem portion. By appropriate control and timing of the vibratory cycle of the grader 180 and the opening of the flapper valves for the outlet chutes of each separator stage, if desired, the small stem portion could be weighed first followed by weighing of the large stem portion.

After the weights of the two stem fractions have been stored in memory, the relative stem content, by stem size, of the tobacco sample is determined in the same manner as described above in connection with the first embodiment of the invention. If the "wet" and "dry" weights of the tobacco sample have been measured using the scales 162,179 the actual moisture content, or the measured dry weight from scale 179, may be used in lieu of the assumed 13% moisture content to calculate the stem content of the sample.

Figure 15:
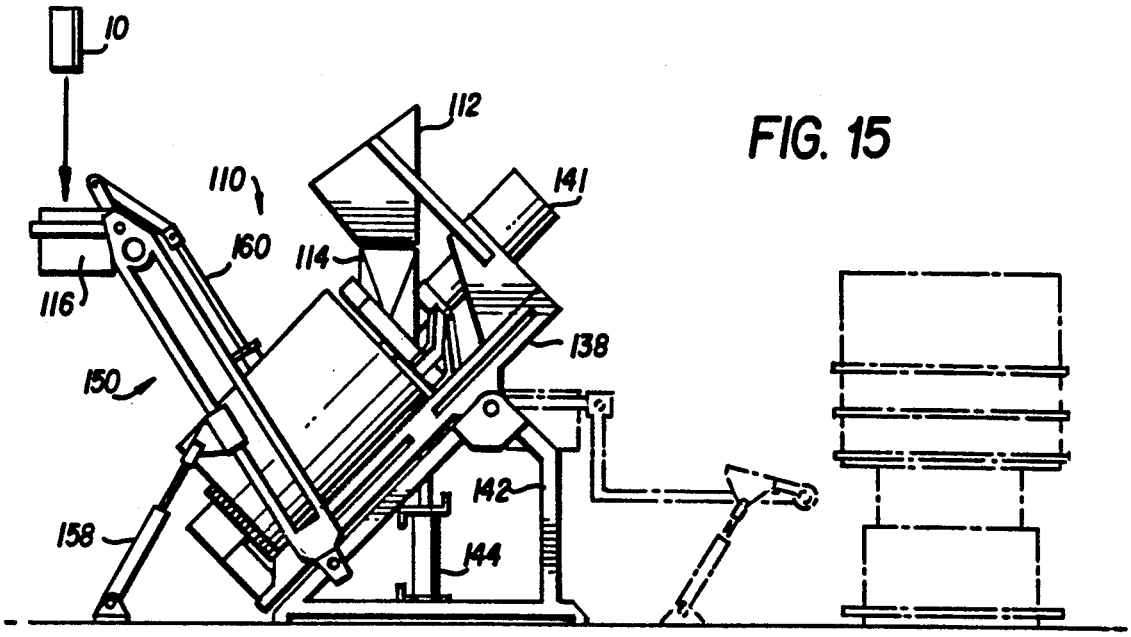
FIGS. 15–20 are side elevation views partly in phantom lines showing the sequence of operation of the second embodiment of the invention from the introduction of the tobacco sample to the apparatus to the discharge of the dried and agitated tobacco sample into the vibratory stem grader.

Referring now to FIGS. 15-20, the operating sequence of the tobacco sample drying and agitating cycle from the introduction of the tobacco sample to the apparatus to the discharge of the dried and agitated sample into the grader 180 will be described. Those portions of the apparatus not necessary to the description of the operation are shown in phantom lines and certain elements shown in FIG. 11 are omitted in FIGS. 15-20 for convenience. FIG. 15 illustrates the positions of the first sample transfer mechanism 150 and the dryer 110 inclined with funnel 114 directed vertically upwardly for receiving a tobacco sample for processing. As shown, the tobacco sample 10 is introduced by any suitable means into the receptacle 116 where the sample is optionally weighed.

Figure 16:
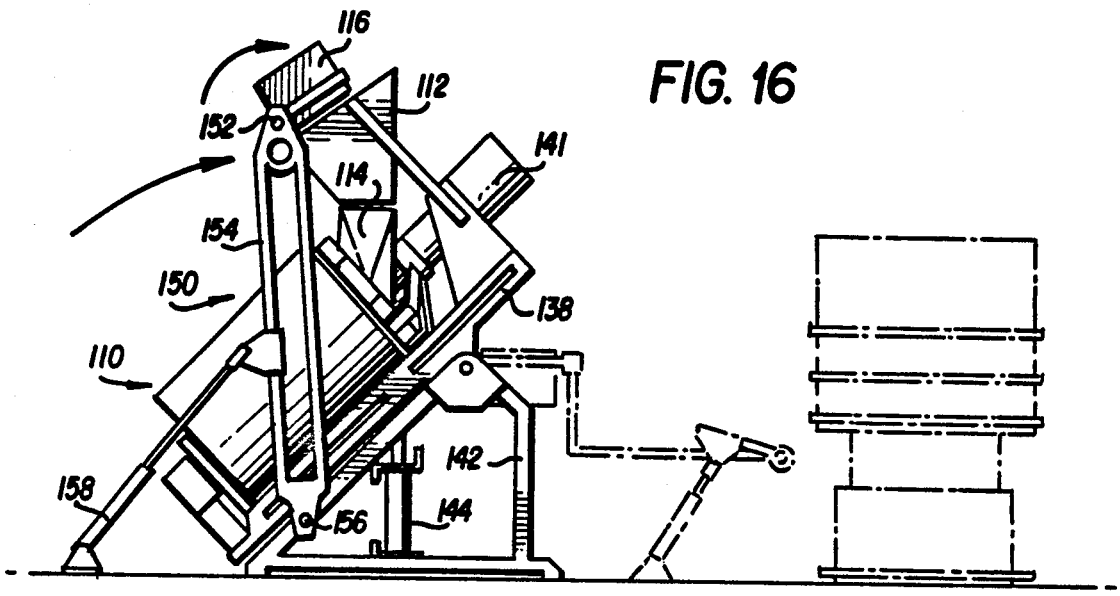

FIG. 16 illustrates the manner in which the first transfer mechanism 150 deposits the tobacco sample into the dryer 110. Pneumatic operator 158 is extended to pivot arms 154 clockwise about pivot pins 156. As the receptacle 116 approaches the hopper 116 pneumatic operator 160 (hidden behind the dryer components) is retracted thereby pivoting the receptacle 116 clockwise about pivot pins 152 and discharging the tobacco sample into the interior drum of the dryer 110 via the hopper 112 and funnel 114. The axis of the funnel 114 is directed substantially vertically upwardly. The first transfer mechanism 150 is then returned to its initial position shown in FIG. 15.

Figure 17:
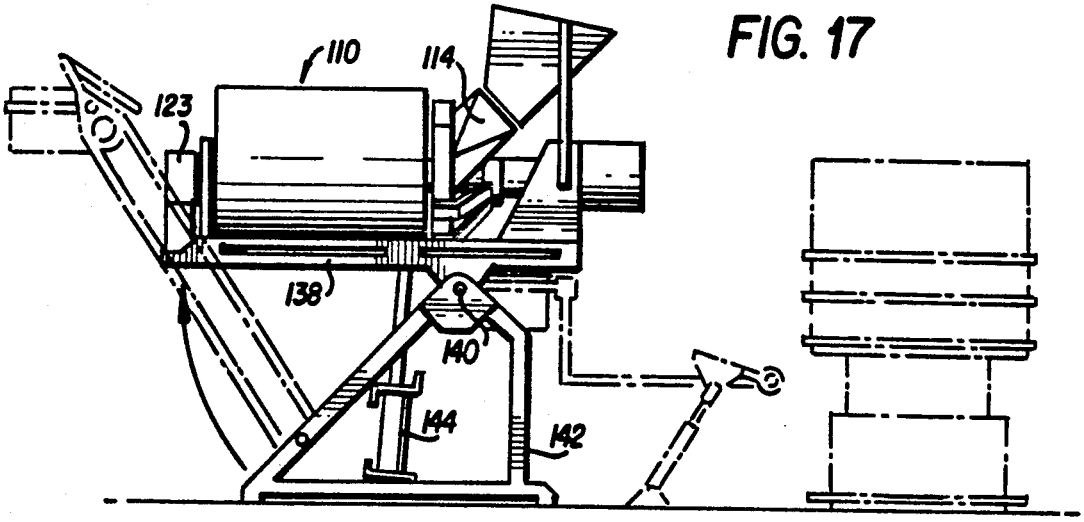

FIG. 17 illustrates the position of the dryer 110 during the drying and agitating cycle of the apparatus. The pneumatic operator 144 is extended to pivot the dryer carriage 138 clockwise about pivot pins 140 through an angle of about 45° so that the rotational axis of the drum dryer 110 is horizontal to insure substantially uniform distribution of the tobacco sample from end-to-end of the vaned heating drum 118. With the dryer 110 in this position, the drive motor 141 and heating elements 132 (FIG. 12) are energized for a time sufficient to dry and agitate the tobacco sample to the desired 0% moisture content and consistency. It will be seen that the axis of the funnel 114 is inclined upwardly at about a 45° angle which prevents spillage of any portion of the tobacco sample and allows escape of the moisture and volatiles from the tobacco sample.

Figure 18:
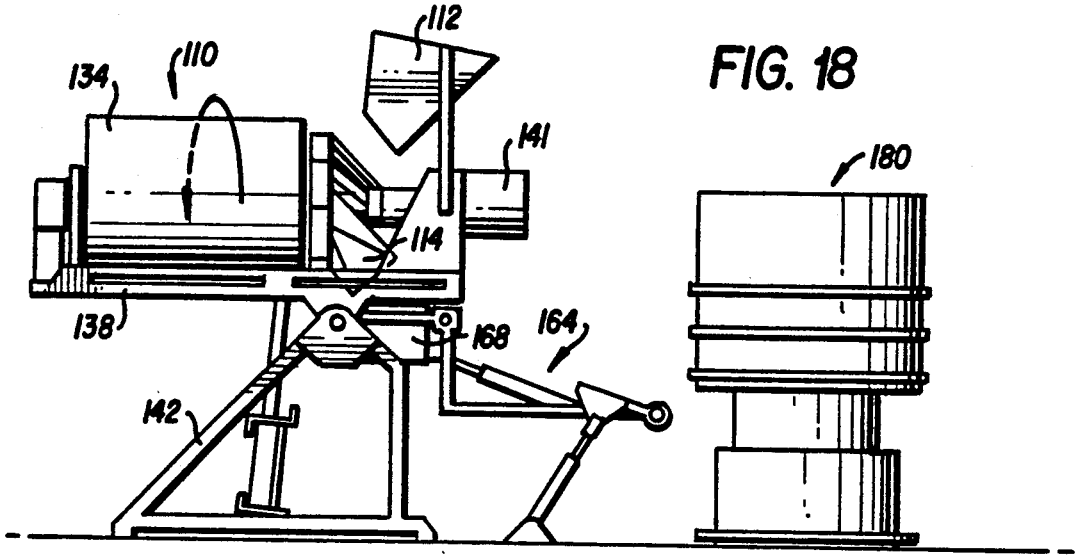

FIG. 18 illustrates the first step in preparing the apparatus for discharge of the dried and agitated tobacco sample from the dryer 110 and transfer of the sample to the vibratory stem grader 180 for classifying the sample into two stem fractions and discharging the lamina and fines. To prepare for the sample discharge step, the air cylinder 126 is supplied with air to rotate the shaft 120 and drum housing 134 through 180°. The funnel 114 is thus reoriented from an upwardly inclined position at about a 45° angle (FIG. 17) to a downwardly inclined position also at about 45° and is located over the receptacle 168 of the second transfer mechanism 164.

Figure 19:
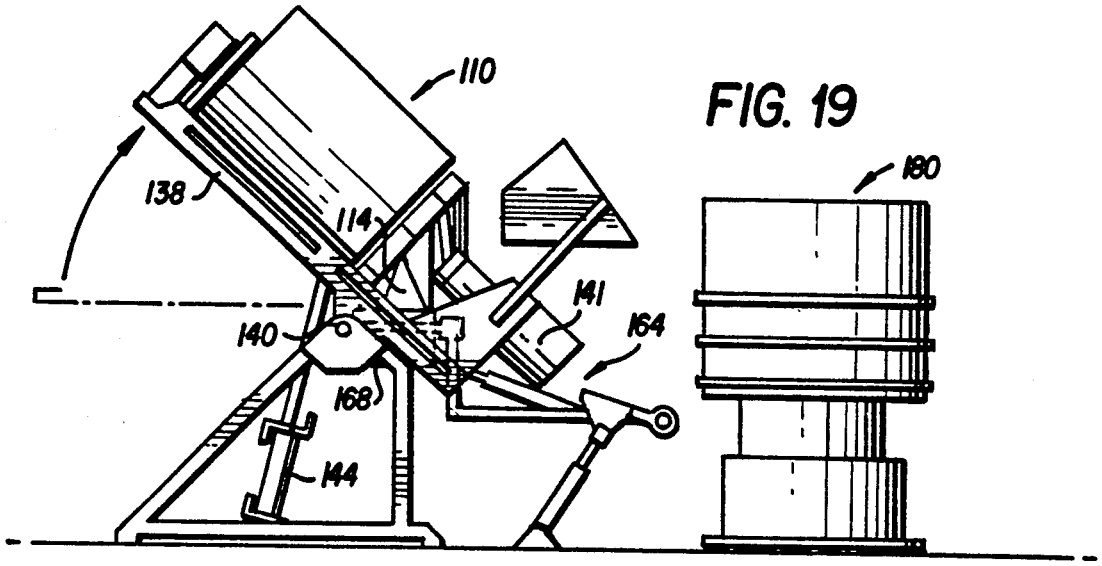

In FIG. 19 the pneumatic operator 144 has been further extended to pivot the dryer carriage 138 upwardly or clockwise about pivot pins 140 through an angle of about 45°. Thus, the axis of the funnel 114 is oriented vertically downwardly at the upper end of the receptacle 168 for discharge of the dried tobacco sample from the dryer. In this position, the heating drum 118 is rotated by the motor 141 to insure complete discharge of the components of the tobacco sample into the receptacle 168.

Figure 20:
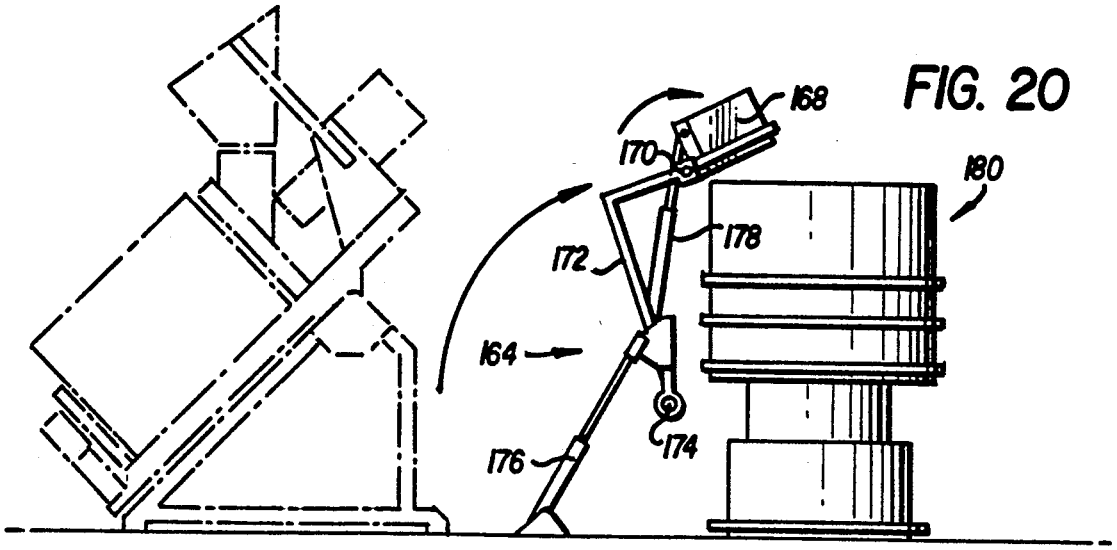

FIG. 20 illustrates the transfer of the dried tobacco sample into the vibratory stem grader 180 by the second transfer mechanism 164. After the dryer 110 has been rotated counterclockwise to its initial position as shown in phantom lines, the pneumatic operator 176 is extended, thereby pivoting the L-shaped arm 172 of the second transfer mechanism clockwise about pivot shaft 174. As the receptacle 168 is raised, the pneumatic operator 178 is actuated to prevent spillage of the sample from the receptacle and then to pivot the receptacle about pivot pins 170 to discharge the sample into the vibratory stem grader 180.

It will be appreciated that if the tobacco sample is preweighed either prior to entry into the apparatus 100 or by the scale 162 at the receptacle 116, it is only important to insure that none of the stem portions of the sample are lost, or spilled or left as residue in the process of transferring the sample through the apparatus. Thus, tobacco lamina and fines that become airborne or are left as residue on or in the components of the system, do not affect the accuracy of the determination of stem content of a given sample or of the samples measured thereafter.

Although certain presently preferred embodiments of the invention has been described herein, it will be apparent to those skilled in the art to which the invention pertains that variations and modifications of the described embodiment may be made without departing from the true spirit and scope of the invention. Accordingly, it is intended that the invention be limited only to the extent required by the appended claims and the applicable rules of law.

What is claimed is:

1. Apparatus for automatically determining the moisture content of a tobacco sample comprising:

a first scale means for automatically weighing a tobacco sample having a moisture content to be determined and for automatically storing the wet weight of the sample;

a drum having an axis of rotation and an internal space for receiving the tobacco sample;

means for automatically transferring the tobacco sample from the first scale means to the drum after weighing the sample;

means for rotating said drum about its axis of rotation;

means for heating the tobacco sample in the drum to dry the sample to a substantially zero moisture content;

a second scale means for automatically weighing the dried tobacco sample and for automatically storing the dry weight thereof;

means for automatically transferring the dried tobacco sample from the drum to the second scale means; and means for receiving the stored wet and dry weights of the sample and for automatically calculating the moisture content of the tobacco sample based thereon.

2. The apparatus of claim 1, wherein said drum has an open end and including means for tilting the drum about a tilt axis transverse to its axis of rotation for transferring the sample to the drum and for discharging the sample from the drum.

3. A method of automatically determining the moisture content of a tobacco sample in a drum having an internal space and an axis of rotation, comprising the steps of:

automatically weighing a tobacco sample having a moisture content to be determined;

automatically storing the wet weight of the sample;

automatically charging the sample to the internal space of the drum;

rotating the drum about its axis of rotation;

heating the tobacco sample in the drum to dry the sample to a substantially zero moisture content;

emptying the dried sample from the drum;

automatically weighing the dried sample;

automatically storing the dry weight of the sample; and automatically calculating the moisture content of the sample based on the stored wet and dry weights thereof.

4. A method of automatically determining the moisture content of a tobacco sample in a drum having an open end, an internal space and an axis of rotation, comprising the steps of:

automatically weighing a tobacco sample having a moisture content to be determined;

automatically storing the wet weight of the sample;

tilting the drum about a tilt axis transverse to the axis of rotation to a first position with the open end of the drum oriented upwardly above the horizontal for receiving the sample;

automatically charging the sample to the internal space of the drum;

tilting the drum about the tilt axis to a second position with the axis of rotation of the drum oriented substantially horizontally for rotating the drum;

rotating the drum about its axis of rotation;

heating the tobacco sample in the drum to dry the sample to a substantially zero moisture content;

tilting the drum about the tilt axis to a third position with the open end of the drum oriented downwardly below the horizontal for emptying the drum; and rotating the drum in the third position about its axis of rotation;

emptying the dried sample from the open end of the drum;

automatically weighing the dried sample;

automatically storing the dry weight of the sample; and automatically calculating the moisture content of the sample based on the stored wet and dry weights thereof.

5. Apparatus for automatically determining the moisture content of a tobacco sample comprising:

a first scale means for automatically weighing a tobacco sample having a moisture content to be determined and for automatically storing the wet weight of the sample;

a drum having an axis of rotation, only one open end, and an internal space for receiving the tobacco sample;

means for automatically transferring the tobacco sample from the first scale means to the drum after weighing the sample;

means for rotating said drum about its axis of rotation;

means for heating the tobacco sample in the drum to dry the sample to a substantially zero moisture content;

a second scale means for automatically weighing the dried tobacco sample and for automatically storing the dry weight thereof;

means for automatically transferring the dried tobacco sample from the drum to the second scale means; and means for receiving the stored wet and dry weights of the sample and for automatically calculating the moisture content of the tobacco sample based thereon.

6. A method of automatically determining the moisture content of a tobacco sample in a drum having only one open end, an internal space and an axis of rotation, comprising the steps of:

automatically weighing a tobacco sample having a moisture content to be determined;

automatically storing the wet weight of the sample automatically charging the sample to the internal space of the drum through said open end;

rotating the drum about its axis of rotation;

heating the tobacco sample in the drum to dry the sample to a substantially zero moisture content;

emptying the dried sample from the drum through said open end;

automatically weighing the dried sample;

automatically storing the dry weight of the sample; and automatically calculating the moisture content of the sample based on the stored wet and dry weights thereof.

* * * * *